US009933215B2

(12) United States Patent
Ollier

(10) Patent No.: US 9,933,215 B2
(45) Date of Patent: Apr. 3, 2018

(54) HEAT EXCHANGER WITH ADAPTER MODULE

(71) Applicant: DANA CANADA CORPORATION, Oakville (CA)

(72) Inventor: Bernhard Ollier, Cologne (DE)

(73) Assignee: Dana Canada Corporation, Oakville, Ontario (CA)

( * ) Notice: Subject to any disclaimer, the term of this patent is extended or adjusted under 35 U.S.C. 154(b) by 15 days.

(21) Appl. No.: 13/261,976

(22) PCT Filed: Apr. 26, 2013

(86) PCT No.: PCT/CA2013/050319

§ 371 (c)(1),
(2) Date: Oct. 24, 2014

(87) PCT Pub. No.: WO2013/159232

PCT Pub. Date: Oct. 31, 2013

(65) Prior Publication Data

US 2015/0129164 A1 May 14, 2015

(30) Foreign Application Priority Data

Apr. 26, 2012 (WO) ..... PCT/CA2012/050263

(51) Int. Cl.
*F28F 9/007* (2006.01)
*F28F 3/08* (2006.01)
(Continued)

(52) U.S. Cl.
CPC ..... *F28F 9/0075* (2013.01); *F28D 9/005* (2013.01); *F28F 3/08* (2013.01); *F28F 9/00* (2013.01);
(Continued)

(58) Field of Classification Search
CPC .. F28F 3/08; F28F 9/007; F28F 9/0075; F28F 9/0221; F28F 2280/06; F28F 9/0253; F28D 2021/0089; F28D 9/005
See application file for complete search history.

(56) References Cited

U.S. PATENT DOCUMENTS 1,907,036 A 5/1933 Belleau
2,045,657 A 6/1936 Karmazin
(Continued)

FOREIGN PATENT DOCUMENTS

CA 2372399 A1 8/2003
CN 200989226 Y 12/2007
(Continued)

OTHER PUBLICATIONS

International Search Report and Written Opinion re PCT/CA2010/001052 dated Sep. 24, 2010.
(Continued)

*Primary Examiner* — Len Tran
*Assistant Examiner* — Hans Weiland
(74) *Attorney, Agent, or Firm* — Marshall & Melhorn, LLC

(57) ABSTRACT

A heat exchanger module adapted for being mounted directly to the outer surface of the housing of an automobile system component, such as a transmission or engine housing, is provided. The heat exchanger module comprises a heat exchanger fixedly attached to an adapter module. The adapter module contains one of more fluid transfer channels, interface connectors, seals and mounting holes for screws and/or bolts. In one exemplary embodiment, the adapter module is comprised of an adapter plate that is sealed with one or more shim plates, the shim plates also providing a brazing surface for brazing the adapter module directly to the heat exchanger, the heat exchanger therefore being
(Continued)

attached to the adapter module without the use of a base plate.

3 Claims, 18 Drawing Sheets

(51) Int. Cl.

| | |
|---|---|
| ***F28F 9/02*** | (2006.01) |
| ***F28F 9/00*** | (2006.01) |
| ***F28F 21/08*** | (2006.01) |
| ***F28D 9/00*** | (2006.01) |

(52) U.S. Cl.
CPC ..... *F28F 9/0253* (2013.01); *F28F 21/084* (2013.01); *F28F 2280/06* (2013.01)

(56) References Cited

U.S. PATENT DOCUMENTS

| | | | | |
|---|---|---|---|---|
| 4,708,199 | A | 11/1987 | Yogo et al. | |
| 5,176,206 | A | 1/1993 | Nagasaka et al. | |
| 5,529,120 | A | 6/1996 | Howard et al. | |
| 5,810,071 | A * | 9/1998 | Pavlin | F28D 9/005 123/196 AB |
| 5,896,834 | A * | 4/1999 | Gruner | F28D 9/005 123/196 AB |
| 5,927,394 | A * | 7/1999 | Mendler | F28D 9/005 165/166 |
| 5,964,283 | A | 10/1999 | Pavlin | |
| 6,161,615 | A | 12/2000 | Brieden et al. | |
| 6,182,746 | B1 | 2/2001 | Wiese | |
| 6,199,626 | B1 | 3/2001 | Wu et al. | |
| 6,224,334 | B1 | 5/2001 | Siga et al. | |
| 6,263,962 | B1 | 7/2001 | Komoda et al. | |
| 6,340,053 | B1 | 1/2002 | Wu et al. | |
| 6,843,311 | B2 | 1/2005 | Evans et al. | |
| 7,377,308 | B2 * | 5/2008 | Ware | F28D 9/005 165/167 |
| 7,717,164 | B2 | 5/2010 | Richter | |
| 2003/0134233 | A1 | 7/2003 | Su et al. | |
| 2005/0217830 | A1 | 10/2005 | Matsubara et al. | |
| 2006/0237184 | A1 * | 10/2006 | Peric | F28D 9/005 165/283 |
| 2007/0084809 | A1 | 4/2007 | Bradu et al. | |
| 2008/0110605 | A1 * | 5/2008 | Richter | F28D 9/005 165/167 |
| 2008/0257536 | A1 | 10/2008 | Kolbin et al. | |
| 2009/0032231 | A1 | 2/2009 | Komoda et al. | |
| 2010/0044015 | A1 | 2/2010 | Capriz et al. | |
| 2010/0206516 | A1 * | 8/2010 | Muller-Lufft | F28D 9/005 165/96 |
| 2012/0061060 | A1 | 3/2012 | Stoll et al. | |
| 2012/0205085 | A1 * | 8/2012 | Ariyama | F28D 9/005 165/181 |
| 2014/0020866 | A1 | 1/2014 | Bluetling et al. | |

FOREIGN PATENT DOCUMENTS

| | | | |
|---|---|---|---|
| CN | 101317069 | A | 12/2008 |
| DE | 9309741 | U1 | 8/1993 |
| DE | 20010816 | U1 | 11/2001 |
| DE | 102007030563 | A1 | 1/2009 |
| DE | 202011002197 | U1 | 2/2012 |
| EP | 0623798 | A2 | 11/1994 |
| EP | 1876406 | A1 | 1/2008 |
| FR | 2948755 | A1 | 2/2011 |
| JP | 11236811 | A | 8/1999 |
| JP | 2011-140915 | A | 7/2011 |
| WO | 03/091647 | A1 | 11/2003 |
| WO | 2006/111006 | A1 | 10/2006 |

OTHER PUBLICATIONS

International Search Report and Written Opinion re PCT/CA2011/001242 dated Feb. 16, 2012.
English Machine Translation of EP 0623798A2.
Four drawings of a heat exchanger module on one sheet and four additional sheets containing enlarged versions of the same images; each of the four additional sheets contains only one enlarged drawing per sheet; total number of sheets: five.
English Machine Translation of DE9309741U1.
Extended European Search Report for EP Appln. No. 13782050.2 dated Jul. 4, 2016.

* cited by examiner

HEAT EXCHANGER WITH ADAPTER MODULE

CROSS-REFERENCE TO RELATED APPLICATION

This application claims the benefit of and priority to International Application No. PCT/CA2012/050263, filed on Apr. 26, 2012 under the title HEAT EXCHANGER WITH ADAPTER MODULE. The content of the above patent application is hereby expressly incorporated by reference into the detailed description hereof.

TECHNICAL FIELD

The invention relates to heat exchangers, and in particular, to heat exchangers adapted for direct mounting to the housing of an automobile system component.

BACKGROUND

Plate-type heat exchangers comprising a plurality of stacked heat exchanger plates are known for a variety of purposes, including heat exchange between oil and a heat exchange fluid. A known way of mounting a stacked plate heat exchanger is to mount a planar, stamped base plate at one end of the stack, for example, the bottom end. The base plate can be brazed to the heat exchanger with or without the use of a shim plate. In order to incorporate the heat exchanger into an automobile heat exchanger system, for example, the heat exchanger with base plate is then, typically, mounted to a cast or moulded adapter structure which in turn is mounted to the transmission or engine housing, for example, using additional fluid lines and/or connectors. The cast or moulded adapter structure includes mounting holes, fluid transfer channels, fluid fittings, filters, etc. to allow the heat exchanger to be incorporated into the overall heat exchange system. In some instances the cast or moulded adapter structure is made of plastic and in other instances it is a more heavy-duty casting that can be quite complex in structure and costly. In both instances, the adapter structure contributes to the overall height and weight of the heat exchanger component as well as to the overall manufacturing costs.

In the field of automotive heat exchanger manufacture, weight limitations as well as space limitations are becoming increasingly restrictive. Accordingly, efforts are constantly being made to reduce component weight as well as component height and/or size. Efforts are also being made to reduce the complexity and increase the adaptability and/or flexibility of components to facilitate assembly and mounting of the component within the overall system and in an effort to reduce overall manufacturing and/or assembly costs. For instance, reducing the overall number of components or component interfaces that result from mounting or integrating a component within an overall system reduces the number of potential leakage points thereby reducing testing requirements as well as assembly steps. Reducing the complexity of components and reducing the number of more complex fluid connections between components also serves to reduce costs and is, therefore, desirable.

In automobile heat exchange systems, one manner of accommodating or adjusting to space limitations is to consider mounting heat exchangers directly to a related automotive system component without the use of an intervening adapter or mounting structure. For instance, it is not uncommon for an engine oil cooler (EOC) to be mounted directly to the exterior of the automobile engine housing. An example of an EOC mounted directly to the exterior of the engine housing is shown in JP2011-140915A.

The structure of the engine housing is, generally, somewhat conducive to mounting a heat exchanger directly to the exterior of the engine housing. The area of the cylinder head generally provides a flat, machined recess to which the heat exchanger can be bolted while having direct access to the oil inlet and return passages. However, by bolting the heat exchanger to the cylinder head in this area the heat exchanger must bridge or span the machined recess and must therefore be relatively stiff to minimize deflections from the relatively high cyclic pressure loads of the oil system inherent to the engine, which tend to be amplified depending upon the exact distance bridged by the heat exchanger. Accordingly, specific structural requirements need to be addressed when mounting a heat exchanger directly to the engine housing, while still keeping overall height and space limitations in mind.

While directly mounting heat exchangers to the exterior of the engine housing requires that a certain degree of structural rigidity be met, the structure of the housings of other automobile system components also present challenges related to the direct mounting of heat exchangers to the component housing. For instance, in the case of transmission housings, the housings are generally curved and are much larger in size which makes it difficult to provide a wide, generally flat area/recess for mounting a heat exchanger without intruding vertically into the internal parts of the transmission. Furthermore, transmission oil supply feed lines and/or oil ports are generally spaced farther away from each other and outside the footprint area of conventional heat exchangers used for this purpose. As well, the exact location/position of the oil ports is often variable. These factors contribute to difficulties associated with direct mounting a heat exchanger, such as a transmission oil cooler (TOC), to the exterior of the transmission housing.

Accordingly, there is a need for a heat exchanger with an improved mounting arrangement which allows for the direct mounting of the heat exchanger to the housing of an automobile system component.

SUMMARY OF THE PRESENT DISCLOSURE

According to one aspect of the present disclosure there is provided a heat exchanger module for mounting directly to the outer surface of a housing of an automobile system component, the heat exchanger module comprising a heat exchanger comprising a plurality of stacked heat exchange plates defining alternating first and second fluid paths through said heat exchanger, the heat exchanger having a footprint corresponding to the area defined by the stack of heat exchange plates; a pair of first fluid manifolds extending through the heat exchanger and coupled to one another by the first fluid paths, the pair of first fluid manifolds comprising an inlet manifold and an outlet manifold for the flow of a first fluid through said heat exchanger; a pair of second fluid manifolds extending through the heat exchanger and coupled to one another by the second fluid paths, the pair of second fluid manifolds comprising an inlet manifold and an outlet manifold for the flow of a second fluid through said heat exchanger; an adapter module having a first surface attached to an end of the heat exchanger and a second surface opposite to said first surface and adapted for face-to-face contact with an interface surface on the outer surface of the housing of the automobile system component, the adapter module comprising at least one fluid transfer channel formed in the adapter module for communicating with one of the inlet and outlet manifolds of one of said pairs of fluid manifolds; a first port communicating with the at least one fluid transfer channel, the first port being located outboard the heat exchanger footprint; and a second port for communicating with the other one of the inlet and outlet manifolds of said pair of fluid manifolds; wherein the first and second fluid ports are formed in the second surface of the adapter module and have mounting surfaces oriented and adapted for fluid communication with corresponding fluid inlet and outlet ports formed in the interface surface on the housing of said automobile component; and wherein said adapter module further comprises a series of mounting holes for securing said heat exchanger to said automobile system component at said interface surface, the adapter module transferring at least one of the first and second fluids between said heat exchanger and said automobile system component through a fluid port outboard of the footprint of said heat exchanger.

According to another aspect of the present disclosure, there is provided a heat exchanger module for mounting directly to the outer surface of a housing of an automobile system component, the heat exchanger module comprising a heat exchanger comprising a plurality of stacked heat exchange plates defining alternating first and second fluid paths through said heat exchanger, the heat exchanger having a footprint corresponding to the area defined by the stack of heat exchange plates; a pair of first fluid manifolds extending through the heat exchanger and coupled to one another by the first fluid paths, the pair of first fluid manifolds comprising an inlet manifold and an outlet manifold for the flow of a first fluid through said heat exchanger; a pair of second fluid manifolds extending through the heat exchanger and coupled to one another by the second fluid paths, the pair of second fluid manifolds comprising an inlet manifold and an outlet manifold for the flow of a second fluid through said heat exchanger; an adapter module having a first surface attached to an end of the heat exchanger and a second surface opposite to said first surface and adapted for face-to-face contact with an interface surface on the outer surface of the housing of the automobile system component, the adapter module comprising a first fluid transfer channel formed in the adapter module, the first fluid transfer channel being in direct fluid communication with one of the inlet and outlet manifolds of one of said pairs of fluid manifolds; a first port formed in the second surface of said adapter module, the first port being in fluid communication with the first fluid transfer channel; a second port formed in the second surface of said adapter module, the second port being in fluid communication with the other one of the inlet and outlet manifolds of said pair of fluid manifolds; and a third port formed in the second surface of said adapter module, the third port being in fluid communication with the first fluid transfer channel; wherein the first fluid transfer channel provides fluid communication between inlet and outlet ports formed in the interface surface of the housing of the automobile system component and an inlet manifold of said heat exchanger.

According to another aspect of the present disclosure there is provided an adapter module for mounting a heat exchanger to the housing of an automobile system component, the adapter module comprising an adapter plate having a first surface for attaching to an end of the heat exchanger, and a second surface opposite to said first surface for direct mounting to the housing of an automobile system component in face-to-face contact with an interface surface on the outer surface of the housing; a shim plate disposed on the first surface of the adapter plate for brazing the adapter plate to the heat exchanger; a trough portion formed in the adapter plate, the trough portion and the shim plate defining a fluid transfer channel therebetween; a first fluid port formed in the second surface of the adapter plate and communicating with the fluid transfer channel; a manifold port formed in the shim plate for providing fluid communication between the fluid transfer channel and an inlet/outlet manifold of said heat exchanger; a plurality of bores formed in the adapter plate, each bore for receiving a fastening device for securing the adapter module to the housing; wherein the adapter plate has an extension portion that extends beyond the heat exchanger footprint, the first fluid port at least partially formed in the extension portion.

According to another aspect of the present disclosure, the heat exchanger module is particularly suited for mounting directly to the transmission housing, the heat exchanger therefore functioning as a transmission oil cooler (TOC).

According to another aspect of the present disclosure, the heat exchanger module is particularly suited for mounting directly to the engine housing, the heat exchanger therefore functioning as an engine oil cooler (EOC).

BRIEF DESCRIPTION OF THE DRAWINGS

Exemplary embodiments of the present disclosure will now be described, by way of example, with reference to the accompanying drawings, in which.

DETAILED DESCRIPTION OF EXEMPLARY EMBODIMENTS

Figure 1:
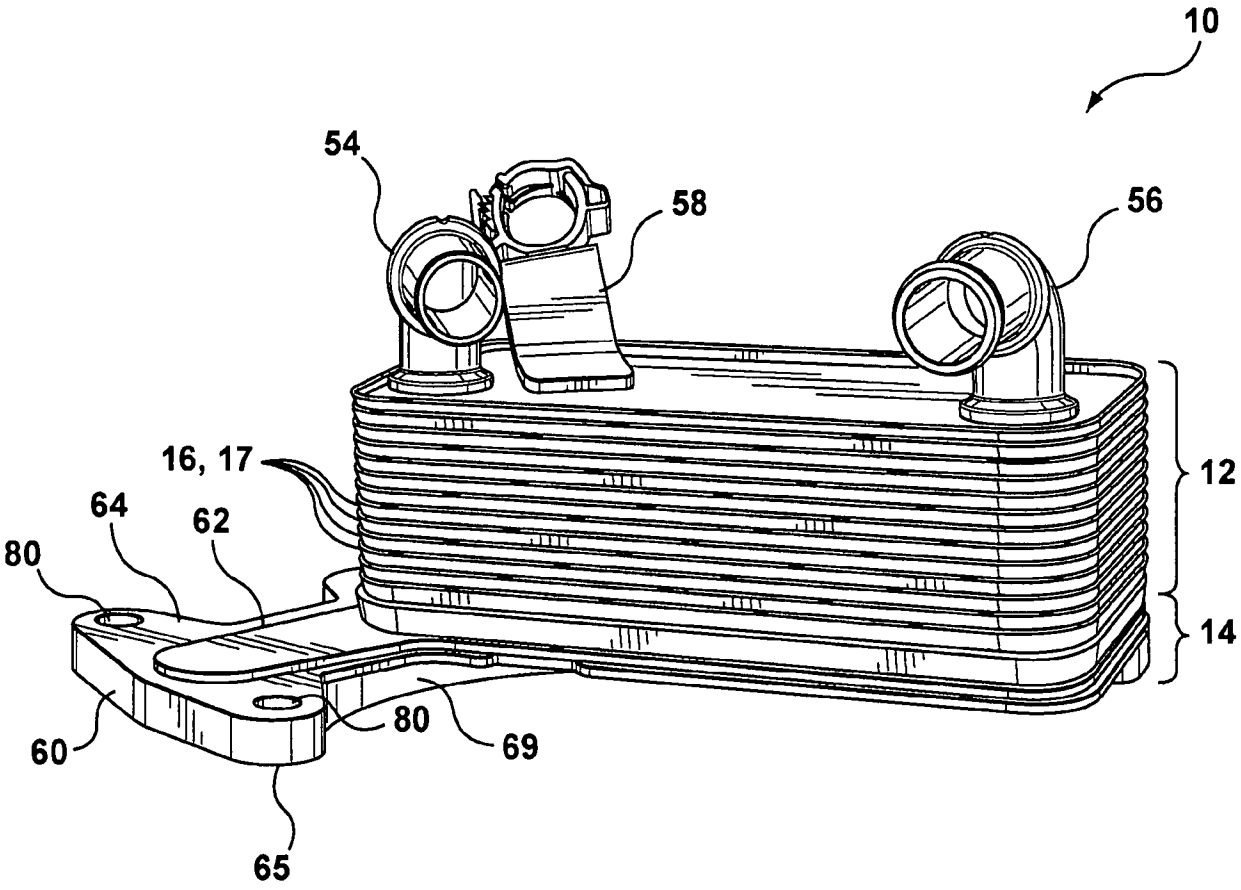
FIG. 1 is a perspective view of a heat exchanger module according to an exemplary embodiment of the present disclosure.

Referring now to FIG. 1, there is shown an exemplary embodiment of a heat exchanger module 10 according to the present disclosure. Heat exchanger module 10 is comprised of a heat exchanger 12 fixedly attached to an adapter module 14. Heat exchanger 12 is generally in the form of a nested, dished-plate heat exchanger, as is known in the art, and is comprised of a plurality of stamped heat exchanger plates 16, 17 disposed in alternatingly stacked, brazed relation to one another to form a heat exchanger core with alternating first and second fluid flow passages 20, 22 formed between the stacked plates 16, 17.

Figure 2:
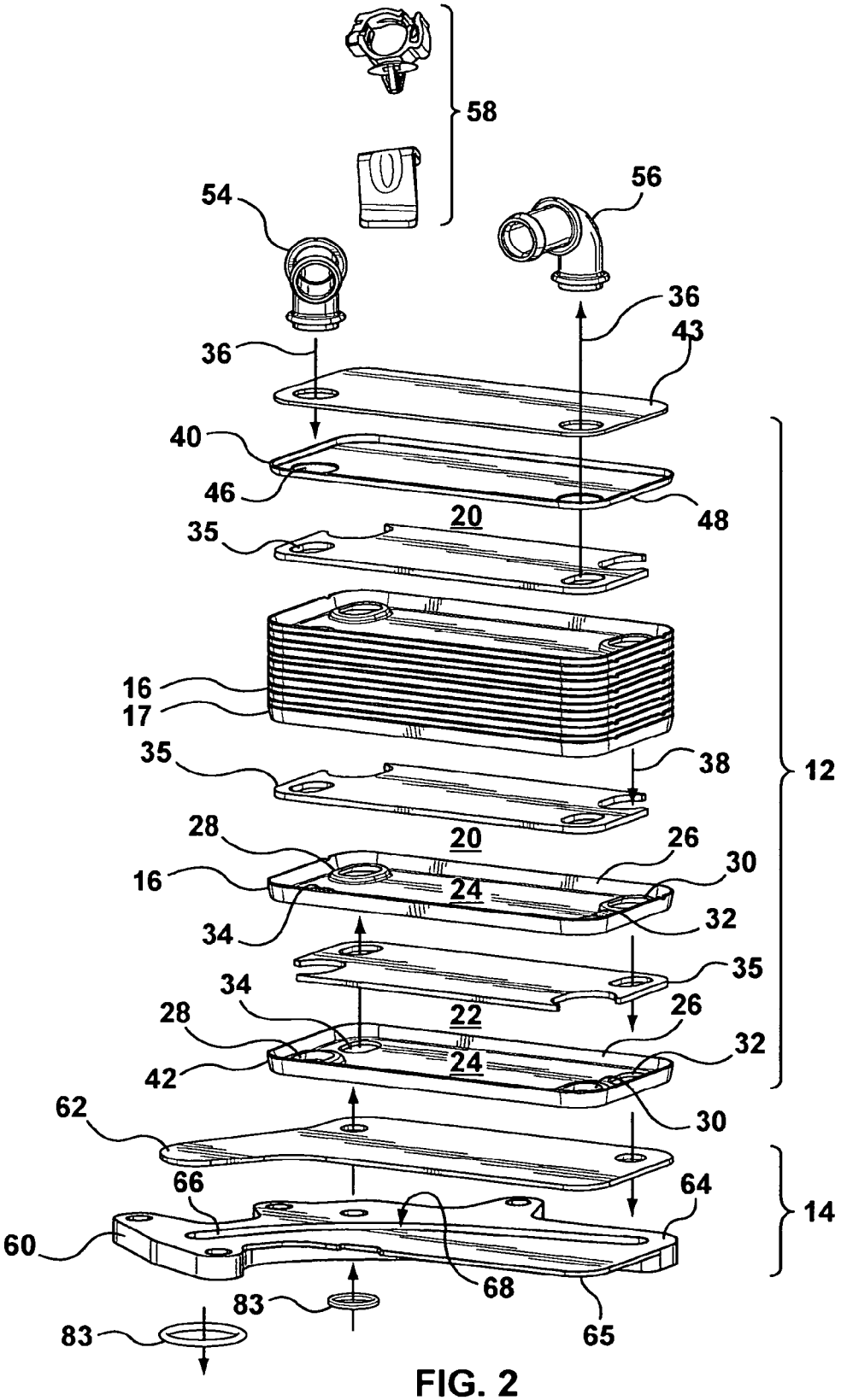
FIG. 2 is an exploded view of the heat exchanger module of FIG. 1.

Referring now to FIG. 2, an exploded view of the heat exchanger module 10 is shown. As illustrated, the stamped heat exchange plates 16, 17 each comprise a generally planar base portion 24 surrounded on all sides by a sloping edge wall 26. The heat exchange plates 16, 17 are stacked one on top of another with their edge walls 26 in nested, sealed engagement. Each heat exchange plate 16, 17 is provided with four holes 28, 30, 32, 34 near its four corners, each of which serves as an inlet hole or an outlet hole for a heat exchange fluid as required by the particular application. Two holes 28, 30 are raised with respect to the base portion 24 of the plate 16 while the other two holes 32, 34 are formed in and are co-planar with the base portion 24. The raised holes 28, 30 in one plate 16 align with and seal against the flat or co-planar holes 32, 34 of the adjacent plate 17 thereby spacing apart the heat exchange plates 16, 17 and defining the alternating the first and second fluid passages 20, 22. Turbulizers 35 can be positioned between each of the plates 16, 17 in each of the first and second fluid passages 20, 22 to improve heat transfer, as is known in the art. Alternatively, rather than having individual turbulizers 35 positioned in each of the fluid passages 20, 22, the plates 16, 17 may themselves may be formed with heat transfer augmentation features, such as ribs and/or dimples formed in the planar base portion of the plates 16, 17, as is known in the art. The aligned, sealing holes 28, 30, 32, 34 in the stacked plates 16, 17 form a pair of first manifolds 36 (i.e. an inlet manifold and an outlet manifold) coupled to one another by fluid passages 20 for the flow of a first fluid through the heat exchanger and form a pair of second manifolds 38 (i.e. an inlet manifold and an outlet manifold) coupled to one another by fluid passages 22 for the flow of a second fluid through the heat exchanger 12. If, for example, the heat exchanger module 10 is intended to be used as an oil heat exchanger (i.e. a transmission oil cooler or TOC), one of the first and second fluids can be oil while the other fluid can be a standard, known liquid for cooling (or heating) oil.

Top and bottom or end plates 40, 42 enclose the stack of heat exchange plates 16, 17 to form the heat exchanger 12. Depending upon the particular application, the end plates 40, 42 are designed with a particular number of conduit openings, each in fluid communication with one of the pairs of first and second fluid manifolds 36, 38 for the inlet and outlet of the first and the second fluids into and out of the heat exchanger 12. In the example shown, end plate 40 has two conduit openings 46, 48 formed therein, while end plate 42 has four openings 28, 30, 32, 34 (two of which are closed/sealed by adapter module 14) and generally has the same form as heat exchanger plates 16, 17 except that it may be slightly thicker than plates 16, 17.

In the illustrated embodiment, inlet/outlet fittings 54, 56 are fixedly attached or brazed to conduit openings 46, 48 in the end plate 40 by means of a shim plate 43. Top or end plate 40 can also be provided with additional fittings or mounting brackets 58, as required, which fittings or mounting brackets 58 can be brazed to end plate 40 by means of shim plate 43.

Heat exchangers of the type described above are generally known in the art and, for instance, described in U.S. Pat. No. 7,717,164, the teachings of which are incorporated herein by reference. Furthermore, the above-described heat exchanger 12 has been described for illustrative purposes and it will be understood that any suitable heat exchanger, as known in the art, may be used in the heat exchanger module 10 of the present disclosure.

Referring now to FIGS. 1, 3, 4 and 5, the adapter module 14 according to one exemplary embodiment of the present disclosure will now be described in further detail. In the subject embodiment, adapter module 14 is comprised of an adapter plate 60 and a shim plate 62. Shim plate 62 is a relatively thin, soft braze clad aluminum sheet which allows the adapter plate 60 to be brazed directly to the end plate or bottom plate 42 of the heat exchanger 12. The adapter plate 60 is typically machined aluminum and is substantially thicker than shim plate 62 and is also substantially thicker than heat exchange plates 16, 17. Adapter plate 60 has a first surface 64 that, together with shim plate 62, is brazed to one end, e.g. the bottom, of heat exchanger 12. As shown in the drawings, heat exchanger 12 has a "footprint" corresponding to the area defined by the base portion 24 of the stacked heat exchange plates 16, 17, the adapter module 14 being fixedly attached to the heat exchanger 12 within the footprint area of the heat exchanger 12. In the subject embodiment, the adapter module 14 has at least a portion that extends beyond the footprint of the heat exchanger 12, as will be described in further detail below.

Adapter plate 60 further defines a trough portion 66 in the first surface 64 thereof which, in combination with the shim plate 62, defines a fluid transfer channel 68. Fluid transfer channel 68 has one end that communicates with one of the fluid manifolds 38 in the heat exchanger via a conduit opening 70 in shim plate 62 positioned within the footprint of heat exchanger 12, and another end that extends away from the heat exchanger in an extension portion or extension arm 69 of the adapter module 14. Trough portion 66 has a fluid port 72 formed at the opposite end of the trough portion (i.e. outboard the footprint of the heat exchanger 12 in the extension portion 69 of the adapter module 14), the fluid port 72 being adapted to fit and be mounted directly to a corresponding fluid port in the housing of an automobile system component (i.e. an oil port on a transmission housing). Adapter plate 60 has another fluid opening or fluid port 76 formed therein which is aligned with a corresponding opening 78 formed in shim plate 62. Fluid port 76 provides another direct fluid connection between one of the manifolds 38 in the heat exchanger 12 and a corresponding fluid port in the component housing. Accordingly, one of the fluids flowing through the heat exchanger will ultimately enter and exit the heat exchanger 12 through the adapter module 14. The adapter plate 60 also has a plurality of bores 80 formed therein, each aligned with a respective bore or mounting hole provided on the component housing for receiving a fastening device (i.e. a bolt), to secure the heat exchanger module 10 to the housing.

Figure 7:
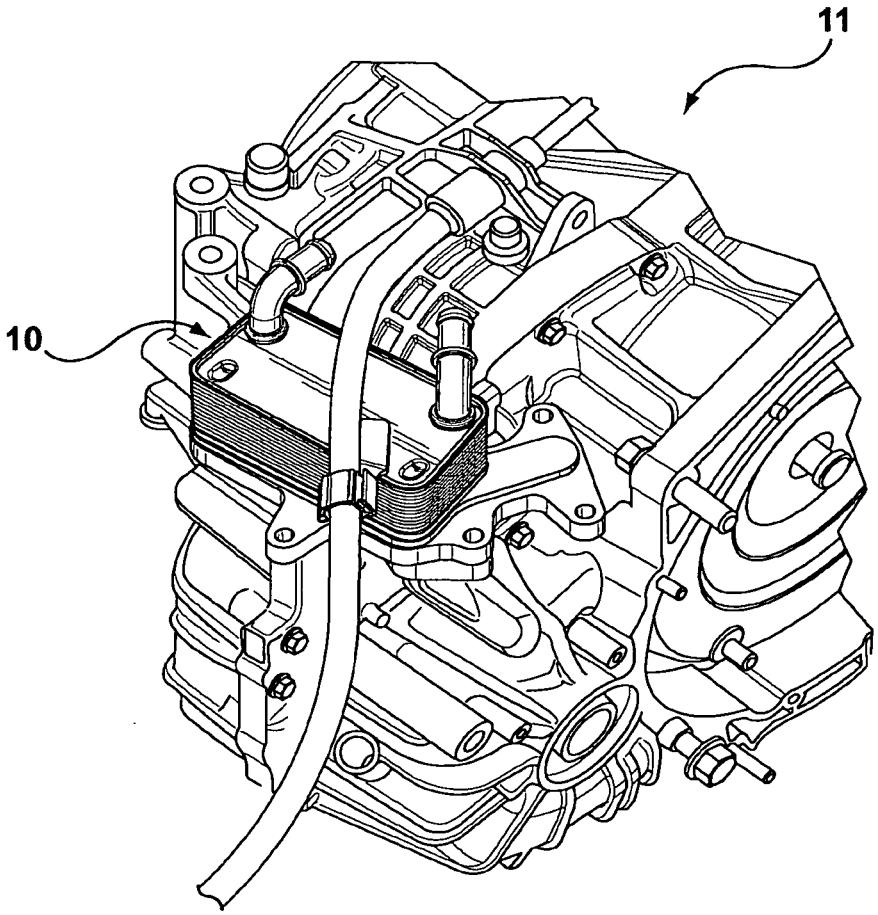
FIG. 7 is a perspective view of the heat exchanger module of FIG. 1 mounted to the exterior of an, exemplary, transmission housing.

FIG. 7 shows the heat exchanger module 10 mounted directly to the exterior of an illustrative embodiment of a transmission housing 11. Therefore, in operation wherein the heat exchanger module 10 is a transmission oil cooler (TOC) mounted directly to the housing of a transmission 11, the second fluid would be transmission oil that would exit the transmission housing and enter the heat exchanger module 10 through a fluid port on the transmission housing coupled directly to fluid port 76 in adapter plate 60. The oil would enter the heat exchanger via opening 78 in the shim plate 62 and be distributed via inlet manifold 38 through fluid passages 22 to outlet manifold 38. The transmission oil would then exit the heat exchanger 12 and enter the adapter module 14 through fluid port 70 in the shim plate 62, travel through fluid transfer channel 68 in the adapter module 14 (or trough portion 66 in the adapter plate 60) and enter the transmission through the outboard fluid port 72 on the adapter module 14, i.e. the fluid port that is outside the footprint of the heat exchanger 12 and is not in direct connection to one of the inlet/outlet manifold ports of the heat exchanger 12. A suitable fluid for cooling (or heating) the transmission oil would also flow through the heat exchanger 12 through inlet and outlets 56, 58 coupled to the corresponding inlet and outlet manifolds 36 in a direction generally opposite to the flow of the transmission oil. Accordingly, it will be understood that the fluid transfer channel 68 and fluid port 72 provides for an indirect fluid connection between a fluid port located on the second surface of the adapter module 14 and one of the fluid manifolds within the heat exchanger since fluid port is at least partially outside the footprint of the heat exchanger 12.

While a particular example of the fluids circuiting through the heat exchanger 12 has been described, it will be understood that this is not intended to be limiting and that variations depending upon the particular structure of the heat exchanger and/or the associated automobile system component may result in a different fluid pattern/circuit through the heat exchanger module 10 as would be understood by those skilled in the art.

While the adapter module 14 is shown as being a relatively flat structure wherein the plurality of bores 80 and the fluid ports are located generally in the same plane, it will be understood that the adapter module 14 can be modified, based on the particular application, to fit the outer surface of the automobile component housing to which it is intended to be fixed. More specifically, the extension portion or extension arm 69 of the adapter plate 60 can be sized and angled as needed to ensure that the adapter module 14 extends to the required location on the component housing to allow for the direct connection between the fluid ports 72, 76 (for example) on the adapter module 14 and the corresponding fluid ports on the component housing. Accordingly, the specific shape and/or size of the adapter module 14 is somewhat dependent upon the structure and corresponding mating surface(s) provided on the component housing. For instance, in the case of a transmission housing, the oil ports are typically spaced apart from each other over an area that is generally larger than the "footprint" of conventional heat exchangers or oil coolers traditionally used for this purpose. The exemplary embodiment of the heat exchanger module 10 described above addresses this issue by brazing the heat exchanger directly to the adapter module 14 provided with the extension portion 69 that allows for "outboard" fluid connections.

Furthermore, while the adapter module 14 described above is generally a flat structure, it will be understood that the adapter module 14 can also be curved to accommodate a curved outer surface of the housing. As well, the adapter module 14 can be formed with projections and/or protrusions extending from the second surface thereof to provide various contact points between the adapter module 14 and various surfaces on the outer housing.

Figure 3A:
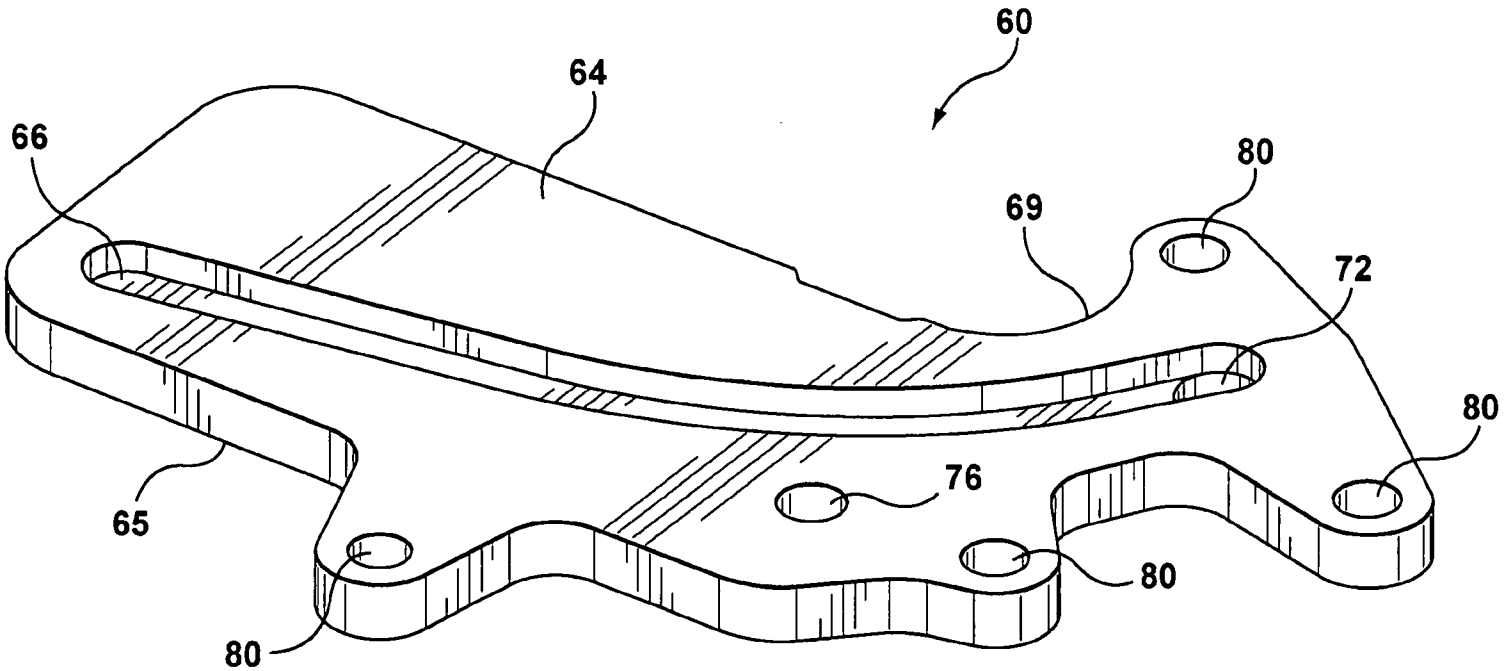
FIG. 3A is a perspective view of an adapter plate that forms part of an adapter module of the heat exchange module as shown in FIG. 2.
Figure 3B:
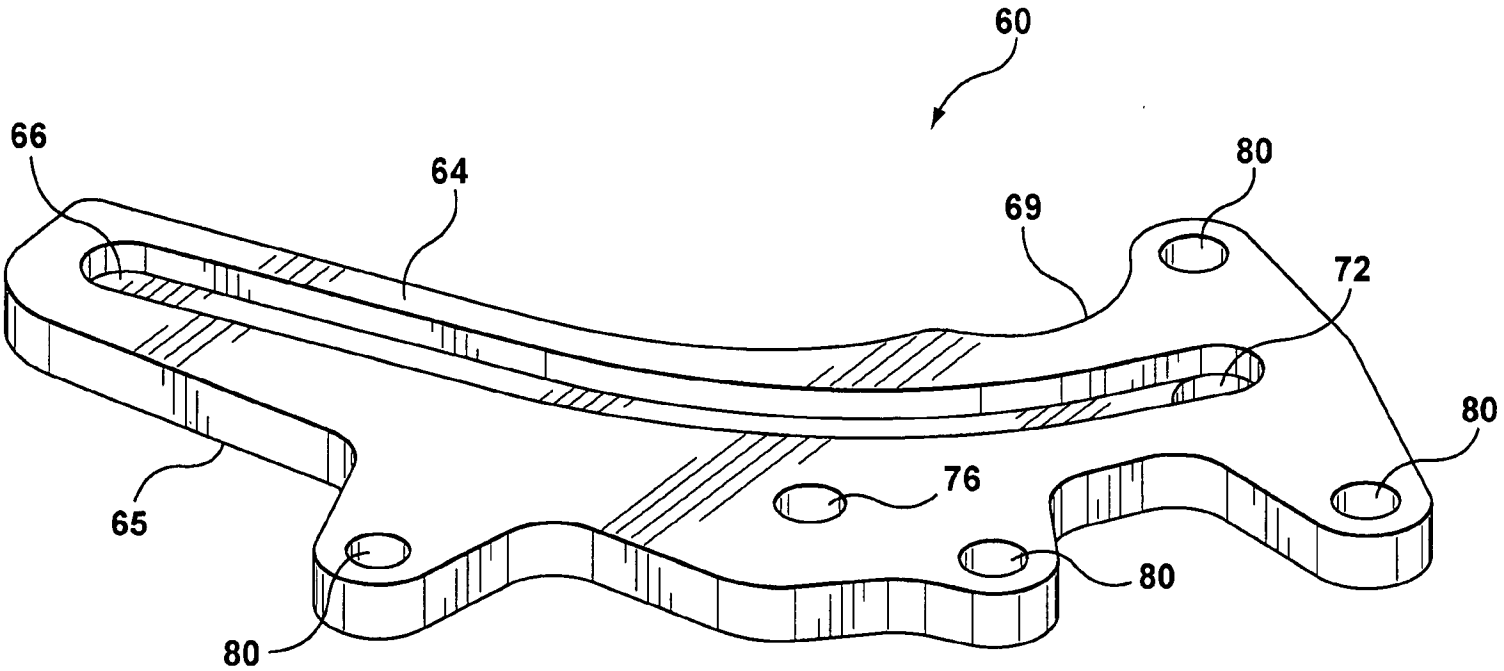
FIG. 3B is a perspective view of an alternate embodiment of the adapter plate of FIG. 3A.

As shown in FIG. 3B, the adapter plate 60 does not need to cover the entire "footprint" or base area of the heat exchanger 12, therefore the bottom or end surface of heat exchanger module 10 may be a tiered or multi-level surface. In other embodiments (as shown in FIG. 3A), the adapter plate 60 may cover the entire "footprint" or base area of the heat exchanger 12, the bottom surface thereof being formed as a multi-level surface.

Figure 4:
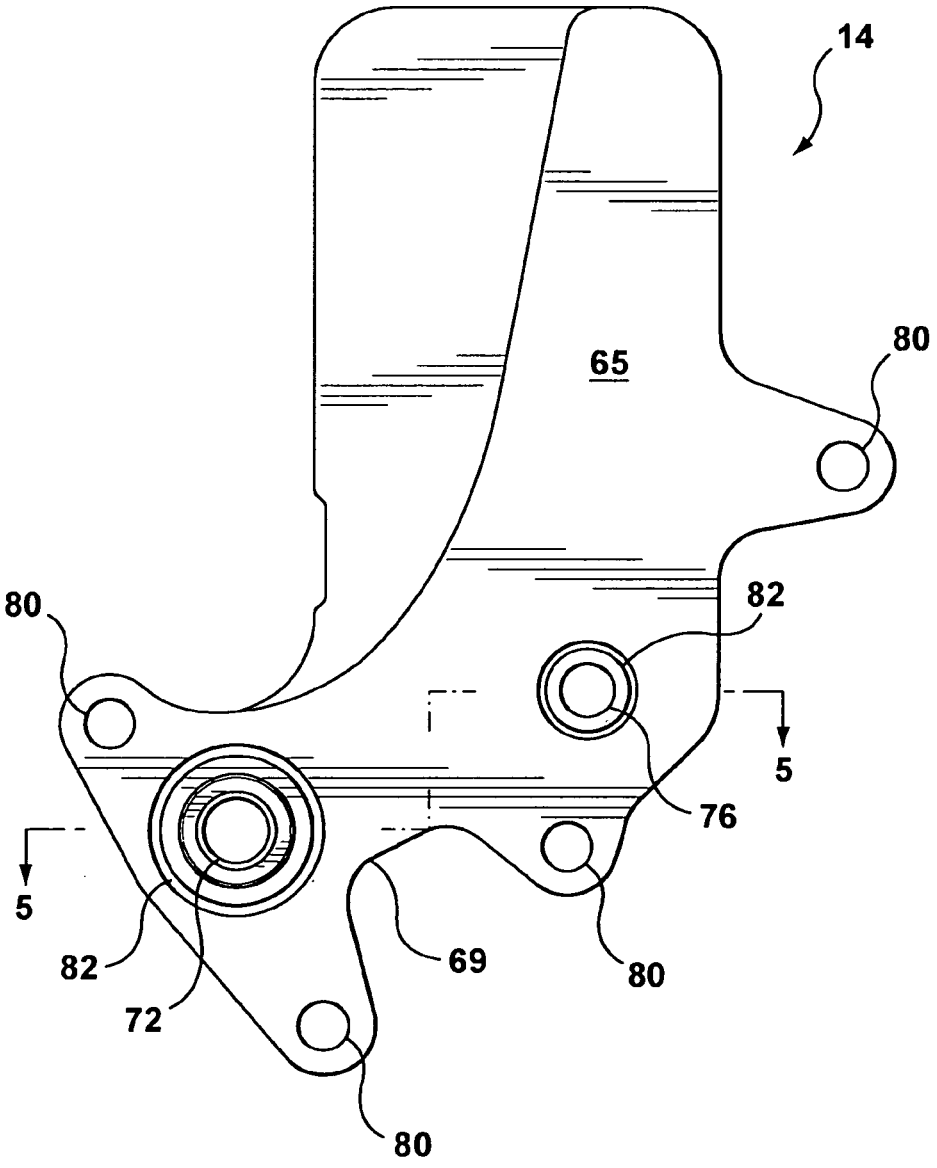
FIG. 4 is a bottom view of the heat exchanger module of FIG. 1.
Figure 5:
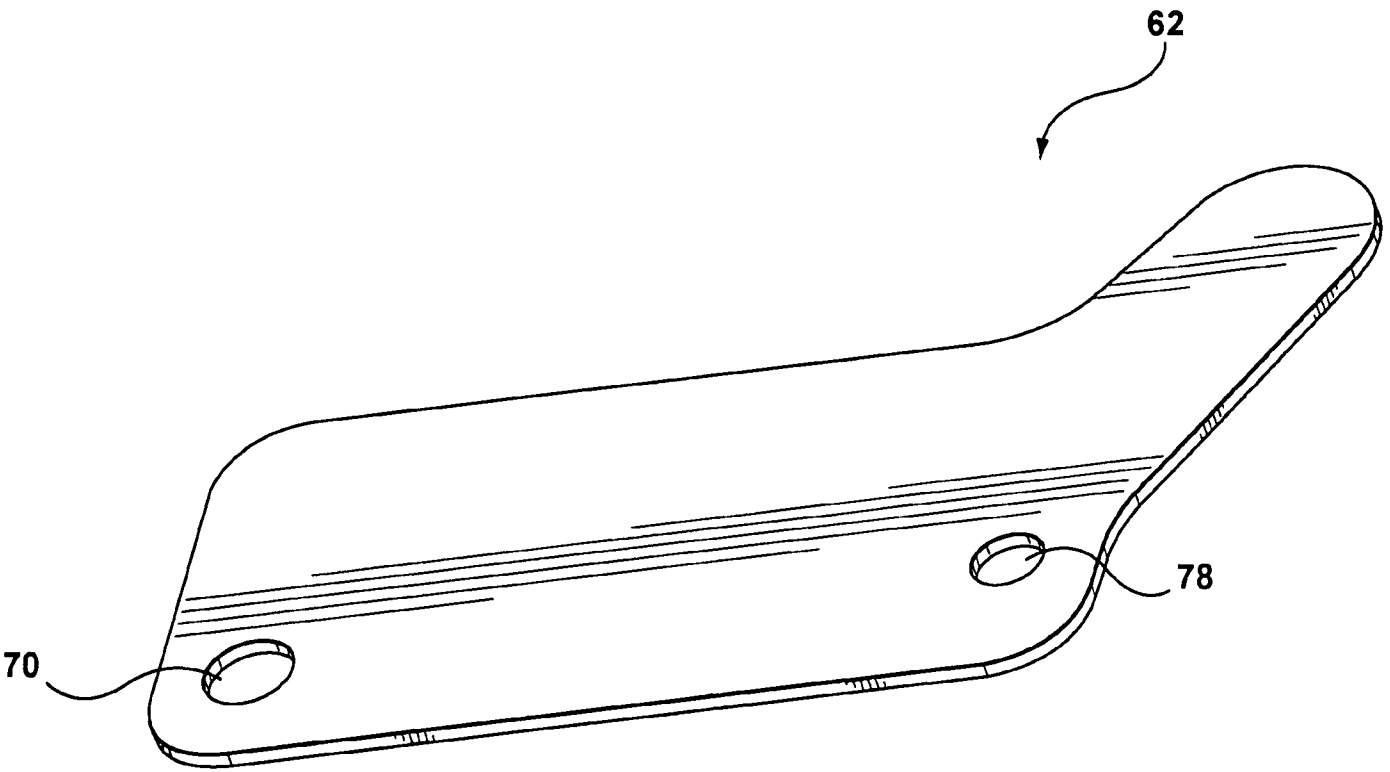
FIG. 5 is a perspective view of a shim plate that forms part of the adapter module of the heat exchanger module of FIG. 1.
Figure 6:
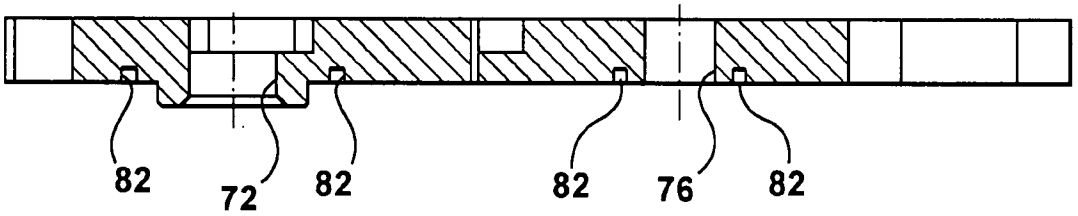
FIG. 6 is a view along section line 5-5 of FIG. 4.

Referring now to FIGS. 2, 4 and 6, the second surface or mounting interface 65 of the adapter module 14 with fluid ports 72, 76 is shown in further detail. A sealing groove 82 is provided around each fluid port 72, 76 for receiving a seal or sealing means 83, such as an o-ring or any other suitable means known in the art. The sealing means 83 provides for a fluid tight connection between the heat exchanger module 10 and the housing of the automobile system component to which it is fixed, such as the transmission housing. In prior art structures wherein a heat exchanger with a stamped base plate or mounting plate is fixed to a plastic cast or moulded structure which, in turn, is mounted to the automobile system component housing, sealing interfaces are required between both the heat exchanger and the plastic structure, and between the plastic structure and the automobile system component. Accordingly, two independent sets of seals are required giving rise to two potential points of failure/leakage, both requiring testing. In the subject embodiment, only one set of seals is required between the heat exchanger module 10 and the housing of the component to which it is fixed.

While the adapter module 14 described above and shown in the drawings has only one fluid channel 68 and two fluid ports 72, 76, it will be understood that the adapter module can be modified to include additional fluid channels and/or fluid ports depending upon the particular application. As well, the adapter module can be modified so as to house additional components such as, for example, one or more control valve(s) (i.e. thermal bypass valve(s)) or filters.

It will be understood that the heat exchanger module 10 described above offers both a reduction in overall component height and weight as compared to various other heat exchanger mounting structures. More specifically, as mentioned above, the adapter module 14 is brazed directly to the bottom or end plate 42 of heat exchanger 12 without the use of a conventional heat exchanger base plate or mounting plate thereby decreasing the overall package height and weight of the heat exchanger module 10. Manufacturing costs may also be reduced due to the elimination of the conventional base plate or mounting plate. As well, since the adapter module incorporates fluid transfer channel(s) and fluid ports, seals and attaching holes all formed therein, the use of a secondary plastic or heavy-duty cast or moulded adapter structure typically used for mounting a heat exchanger to an automobile system component is not required which also reduces the overall package height and weight of the component. Furthermore, by having an adapter module 14 that extends beyond the footprint of the heat exchanger imparts a degree of flexibility or adjustability to the heat exchanger module 10 since fluid ports and/or fluid connection points can be positioned outside the footprint of the heat exchanger.

Figure 7A:
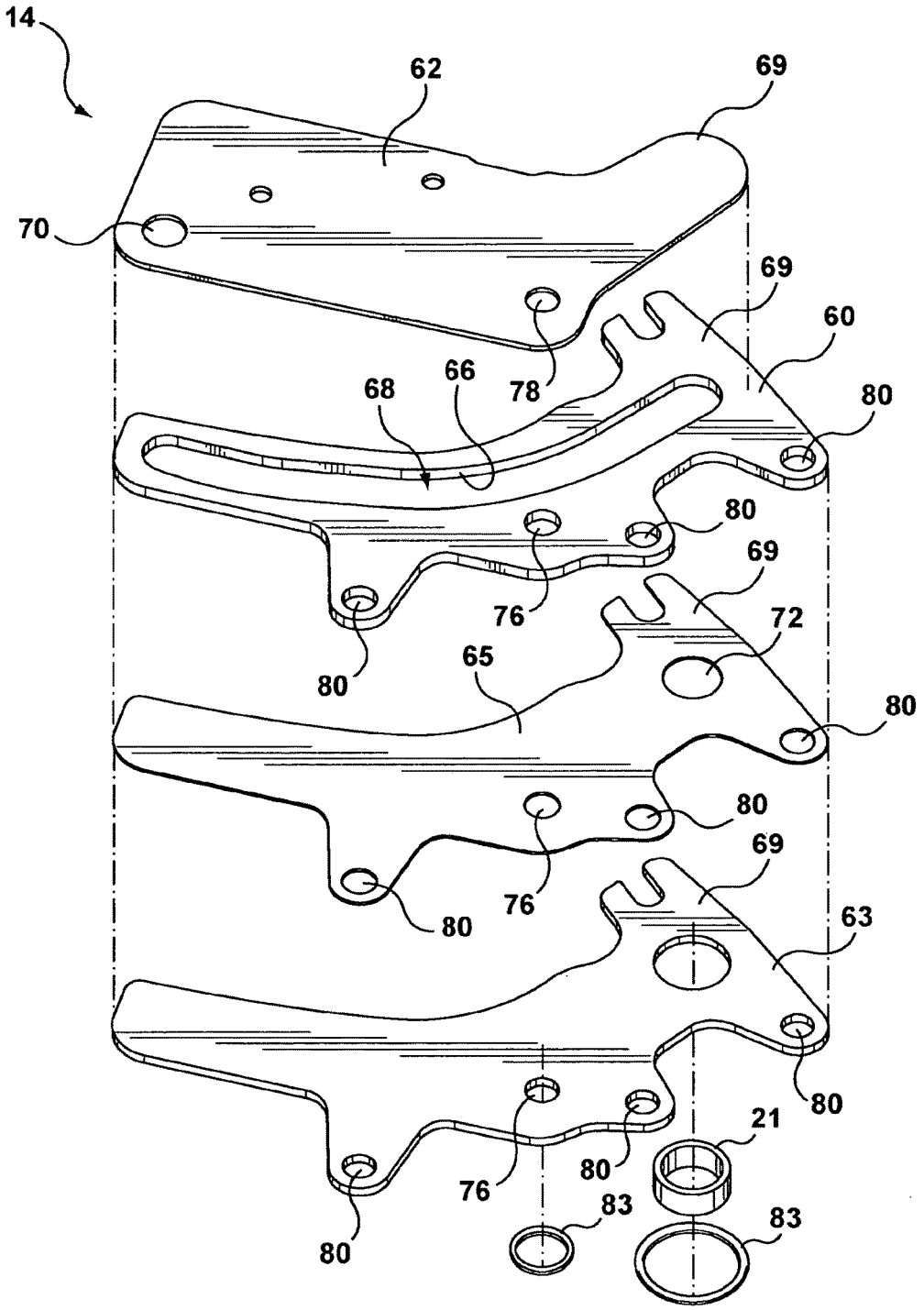
FIG. 7A is an exploded view of an alternate embodiment of the adapter module of the heat exchanger module of FIG. 1.

FIG. 7A illustrates an alternate embodiment or variation of the adapter module 14 described above wherein the adapter module 14 is comprised of a series of layered plates. More specifically, rather than being formed of a single adapter plate 60 and a corresponding shim plate 62, the adapter module 14 in this embodiment is comprised of an adapter plate or channel plate 60 that is sandwiched between shim plate 62 and base plate 63, the base plate 63 being attached to the second or bottom surface of the adapter or channel plate 60 either directly or by means of an intermediate shim plate 62', and having a cylindrical projection 21 extending from its bottom surface. The intermediate shim plate 62' mimics the shape of the adapter plate 60 and the base plate 63 with all the same corresponding openings formed therein and serves to braze the two together. In this embodiment, the adapter plate 60 is formed with a trough portion 66 in the form of a cut-out, the shim plate 62, adapter plate 60 and base plate 63 together forming the fluid transfer channel 68. The layered plate structure of the adapter model 14 shown in FIG. 7A may offer manufacturing advantages and/or cost savings over the embodiment shown in FIGS. 1-7 since the adapter module 14 is comprised of a series of stamped or formed plates rather than a more complex machined singular or unitary adapter plate.

Figure 8:
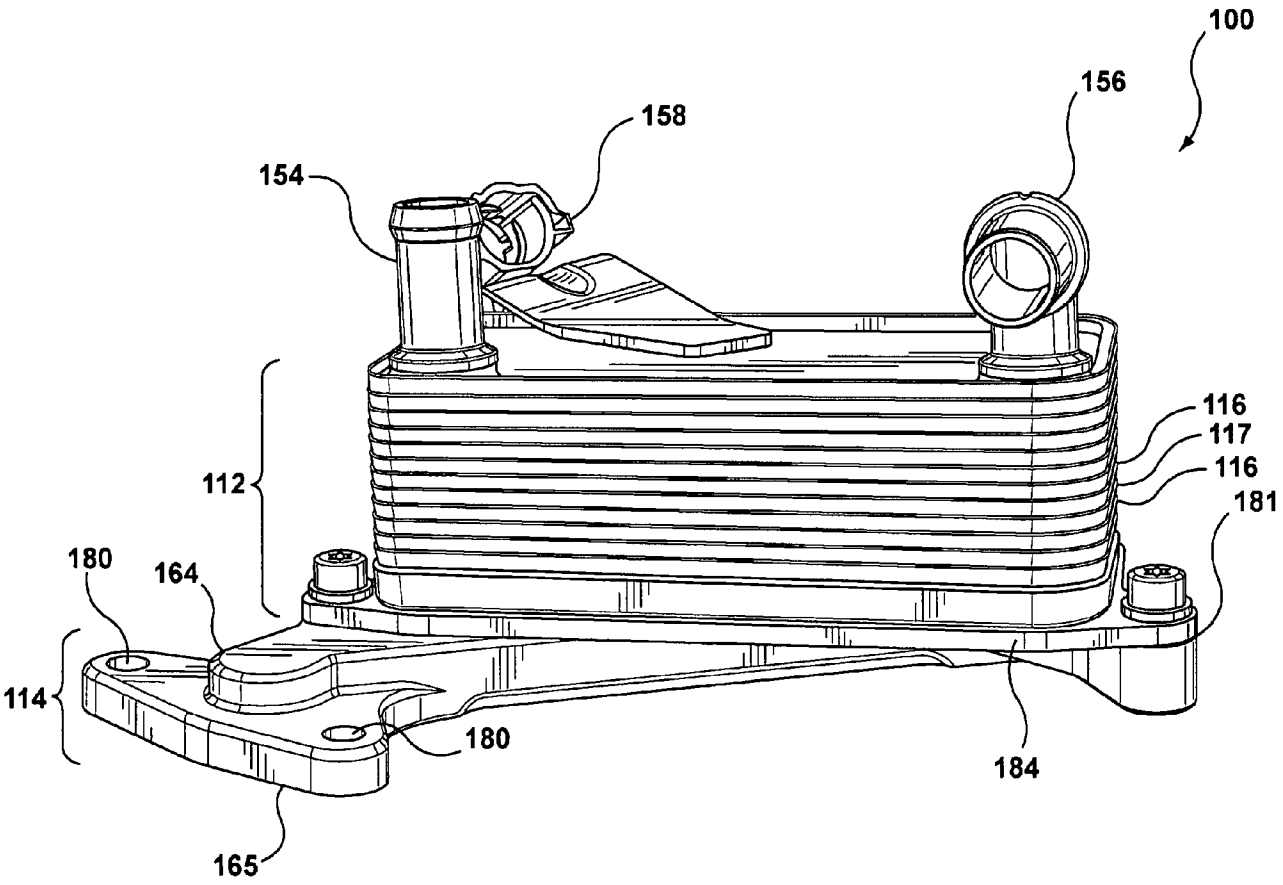
FIG. 8 is a perspective view of a heat exchanger module according to another exemplary embodiment of the present disclosure.
Figure 9:
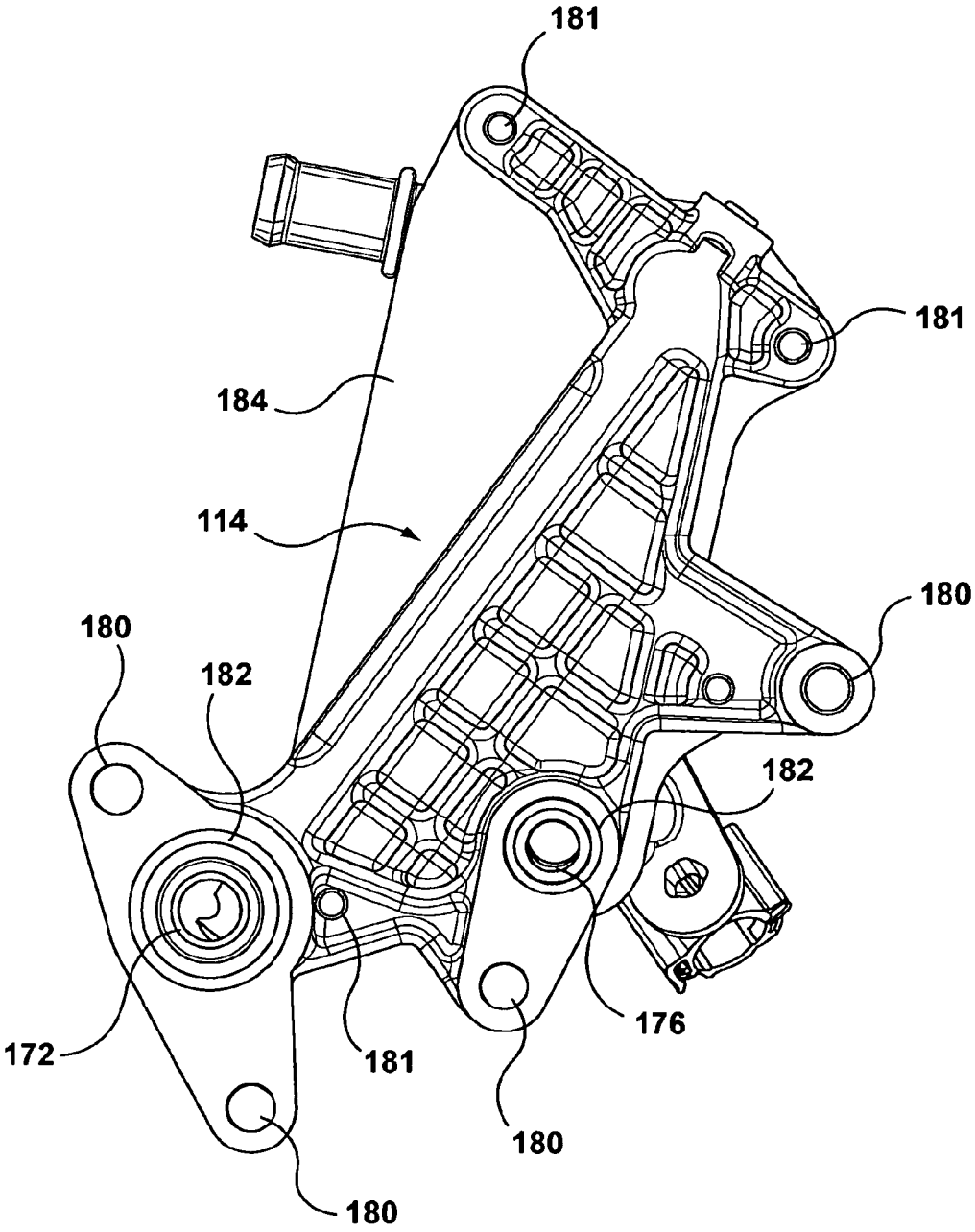
FIG. 9 is a bottom view of the structure of FIG. 8.

Referring now to FIGS. 8 and 9, another exemplary embodiment of the heat exchanger module 100 according the present disclosure will now be described, wherein similar reference numerals, increased by a factor of 100, are used to denote similar features. In the subject embodiment, the heat exchanger 112 comprises a base plate 184 fixedly attached to one end thereof, having inlet/outlet fittings 154, 156 and mounting bracket 158. The base plate 184 may be a stamped plate that is substantially thicker than heat exchanger plates 116, 117. The base plate 184 is typically brazed directly to the end of the heat exchanger 112 or is brazed to the heat exchanger 112 by means of an intermediate shim plate (not shown). Adapter module 114 is a fully enclosed module with a fluid transfer channel formed therein. In the subject embodiment, the adapter module 114 has a first set of bores 181 for aligning with corresponding bores provided in the base plate 184 and a second set of bores 180 for aligning with corresponding bores on the housing of the automobile system component. As well, in the subject embodiment, both the first surface and the second surface 164, 165 of the adapter module 114 are provided with sealing grooves 182 (first surface grooves no shown) around each of the fluid ports or conduit openings 172, 176 to provide seals (i.e. o-rings) between the two separate mounting interfaces.

Once again, while the adapter module 114 described above and shown in the related drawings has only one fluid channel 168 and two fluid ports 172, 176, it will be understood that the adapter module 114 can be modified to include additional fluid channels and/or fluid ports depending upon the particular application.

Figure 10:
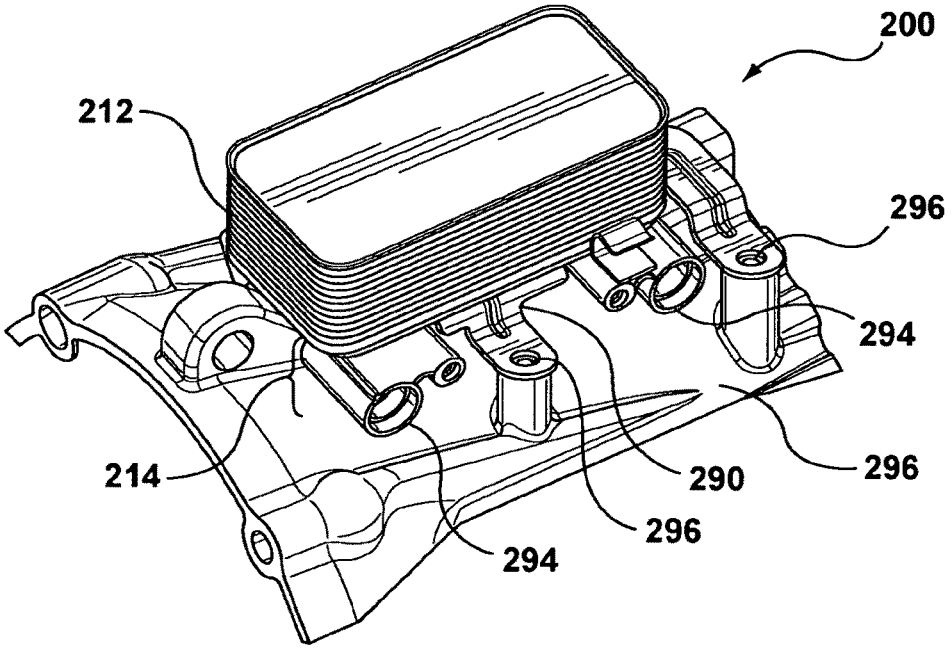
FIG. 10 is a perspective view of a heat exchanger module according to another exemplary embodiment of the present disclosure shown mounted directly on the housing of an automobile system component.
Figure 11:
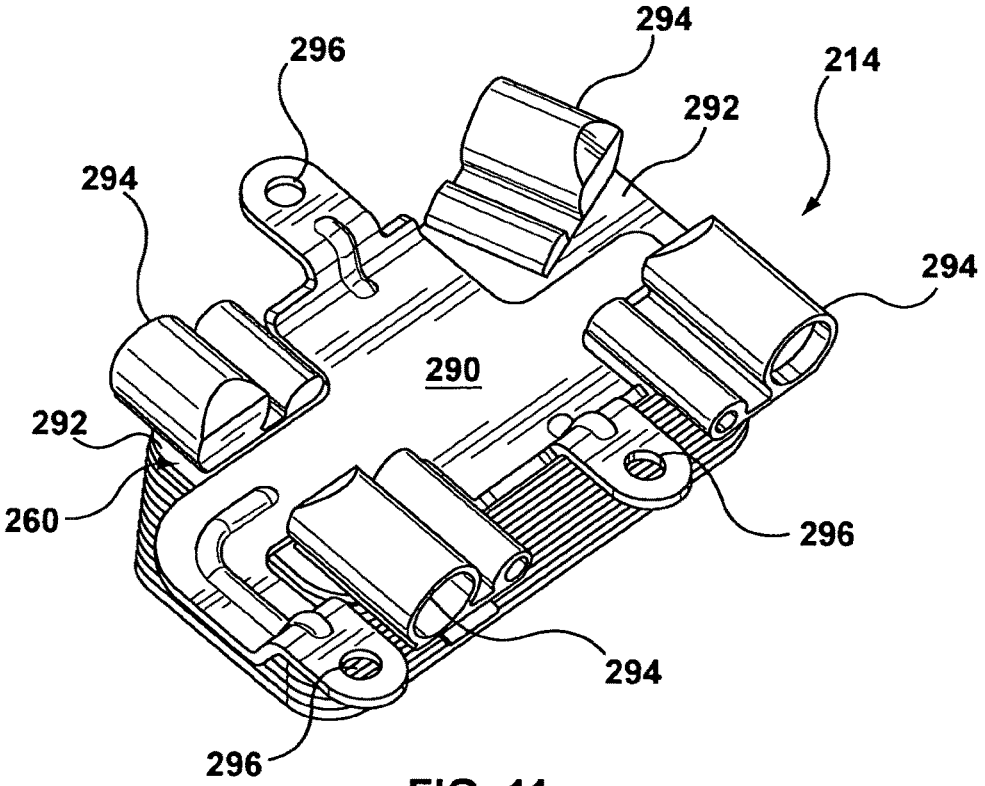
FIG. 11 is a bottom perspective view of the heat exchanger module of FIG. 10.

Referring now to FIGS. 10 and 11, another exemplary embodiment of the heat exchanger module 200 according to the present disclosure will now be described, wherein similar reference numerals, increased by a factor of 200, are used to denote similar features.

In particular applications where more complex fluid connections, fluid channels and/or additional features/components (i.e. valves, filters, etc.) are required, the costs associated with a machined or cast aluminum structure for an adapter module 14, 114 as described above in connection with FIGS. 1-9, may be undesirable. In such instances, the heat exchanger module 200 is comprised of a heat exchanger 212 and an adapter module 214, wherein the adapter module 214 is comprised of an adapter plate 260 and mounting plate 290. Adapter plate 260 has a base in the form of a shim plate 292 that, in the illustrated embodiment, generally corresponds in size and shape to the footprint of the heat exchanger 212, although various other configurations may be used. Individual components and/or adapters 294 for controlling or routing/transferring fluid from the heat exchanger 212 to the automobile system component, such as a transmission, (or vice versa), are individually brazed to one side of shim plate 292. The shim plate 292 is provided with fluid openings therein (not shown) for allowing fluid communication between the fluid manifolds in the heat exchanger 212 and the various components and/or adapters 294. The various components and/or adapters 294 that provide fluid connections to the automobile system component are positioned on shim plate 292 and may be oriented to allow for direct connection between the component and/or adapter 294 and the corresponding fluid port on the component housing. For instance, to allow for direct connection to the housing, the adapters 294 would have to be structured and arranged on shim plate 292 to provide fluid openings at their free end that are vertically or axially aligned with the corresponding fluid ports on the component housing. Otherwise, additional connectors and/or tubing would be required to connect the fluid ports on the component housing to the corresponding fluid openings provided at the free ends of the adapters 294. When the adapters 294 are arranged for direct connection to the fluid ports, by directly brazing the components/adapters 294 to the shim plate 292 and heat exchanger 212, only one set of seals is required between the adapter plate 260 and automobile system component housing interface(s).

While the adapters 294 shown in FIGS. 10 and 11 only extend slightly beyond the footprint of the heat exchanger 212, it will be understood that the size and shape of the adapters 294 can be varied based on the particular application to ensure that fluid ports/connections are provided at the appropriate locations. Alternatively, as mentioned above, additional tubing and/or connectors may be used to connect to the fluid ports on the component housing to the corresponding fluid ports/openings of the corresponding component/adapter 294.

In order to secure the adapter module 214 described above to the outer surface of the automobile system component housing, mounting plate 290 is provided. Mounting plate 290 is brazed to shim plate 292 and is configured to fit between the various components/adapters 294 that are also brazed to shim plate. Mounting plate 290 is provided with a plurality of bores 296 for aligning with corresponding mounting holes on the component housing. Mounting plate 290 can be adapted and configured so that the bores 296 are provided in various planes, some of which may have various axial orientations thereby providing a great deal of flexibility to adapt the heat exchanger module 200 to various component housings.

The exemplary embodiment described above in connection with FIGS. 10 and 11 is particularly suited for applications wherein the automobile system component is a transmission and the heat exchanger is a transmission oil cooler (TOC) since the fluid connections/adapters 294 are brazed directly to the base of the heat exchanger 212 by means of shim plate 292 without the use of a conventional, stamped heat exchanger base plate or mounting plate. Since the cyclic loads/pressures associated with the transmission are somewhat less than those associated with other components (i.e. an engine housing) the added structural rigidity provided by a conventional base plate or mounting plate is not necessarily required. This allows for the direct brazing of the various adapters 294 to the heat exchanger 212 and allows for the direct mounting of the heat exchanger module 200 to the automobile system component housing while offering a reduction in overall package height since the base plate and plastic adapter structure are eliminated and since the adapters 294 can be selected to suit/fit the counter surface on the transmission housing.

Another exemplary embodiment of the heat exchanger module 300 according to the present disclosure is shown in FIGS. 12-15 and is described in further detail below wherein similar reference numerals increased by a factor of 300 have been used to identify similar features.

Figure 12:
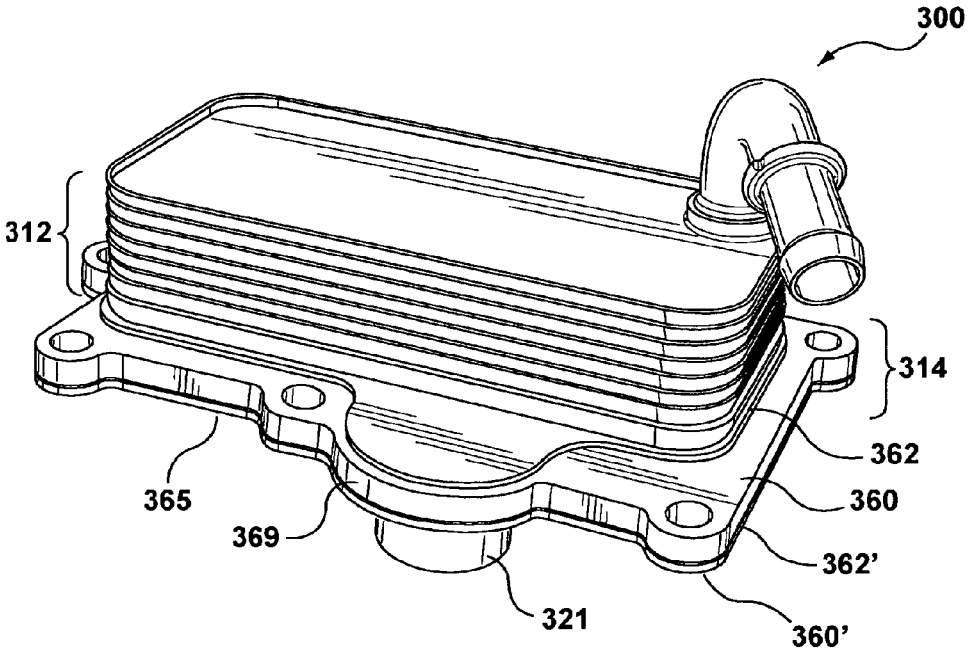
FIG. 12 a perspective view of a heat exchanger module according to yet another exemplary embodiment of the present disclosure.
Figure 13:
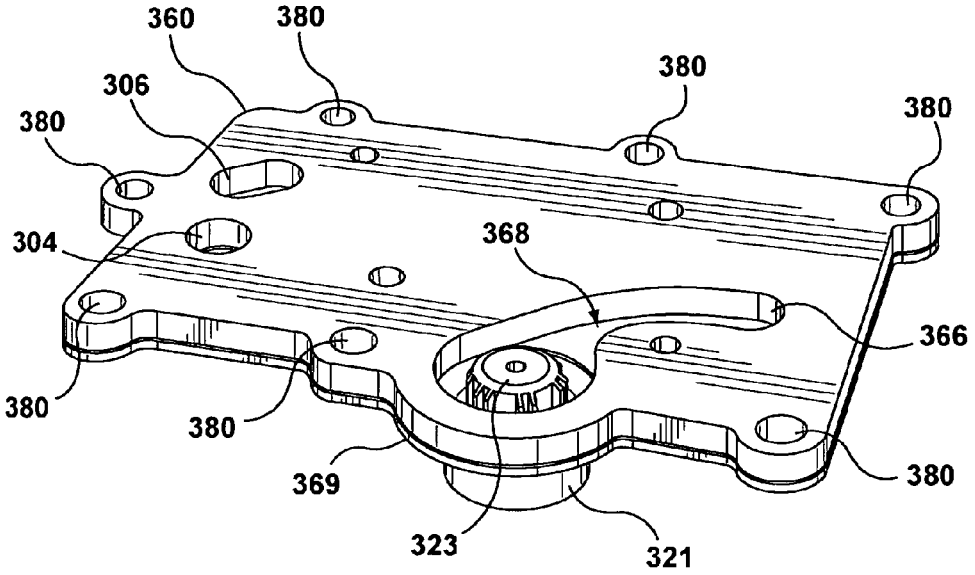
FIG. 13 is a perspective view of a portion of the adapter module that forms part of the heat exchanger module shown in FIG. 12.

As shown in FIG. 12, heat exchanger module 300 is comprised of a heat exchanger 312 fixedly attached to an adapter module 314. In the subject embodiment the heat exchanger module 300 is particularly suited for direct mounting to the exterior of an automobile engine housing (or casing) and, therefore, functions as an engine oil cooler (EOC). However, it will be understood that the heat exchanger module 300 can be adapted for other purposes or applications as discussed above in connection with the other exemplary embodiments disclosed herein.

In the subject embodiment, the adapter module 314 is a layered plate structure and is comprised of a first adapter plate 360 that is brazed directly to the base of the heat exchanger 312 by means of a first shim plate 362. A second adapter plate 360' is brazed directly to the opposite surface of the first adapter plate 360 by means of a second shim plate 362'. Accordingly, the first adapter plate 360 is essentially sandwiched between first and second shim plates 362, 362'. All of the plates 362, 360, 362', 360' used to form adapter module 314 are relatively simple in structure and relatively easy to manufacture, as compared to some known, conventional complex casting adapter structures.

First adapter plate 360 is a relatively thick, machined or formed aluminum plate that offers the required structural rigidity for directly mounting the heat exchanger module 300 to the engine housing, while shim plates 362, 362' are substantially thinner than adapter plate 360 and are made of braze clad aluminum. The first adapter plate 360 includes trough portion 366 in the form of a cut-out within the first adapter plate 360. The cut-out or trough portion 366 extends into the extension arm or extension portion 369 of the adapter module 314. The cut-out or trough portion 366 in the first adapter plate 360, together with the first and second shim plates 362, 362' form the at least one fluid transfer channel 368 in the adapter module 314 as the shim plates 362, 362' essentially enclose the cut-out or trough portion 366 to form the fluid transfer channel 368. As in the previously described embodiments, one end of fluid transfer channel 368 communicates with one of the fluid manifolds in heat exchanger 312 (i.e. the oil inlet manifold, for example) via a corresponding opening (not shown) formed in the first shim plate 362. The other end of the fluid transfer channel 368 extends into the extension portion 369 of the adapter module 314 and is adapted for fluid connection to a corresponding fluid port on the automobile system component housing (i.e. the engine oil outlet on the engine housing). The extension portion 369, therefore providing an indirect fluid connection (i.e. at least partially outside the boundary of or the footprint of the heat exchanger core) to one of the fluid manifolds within the heat exchanger.

First adapter plate 360 is also provided with two additional fluid openings 304, 306 each of which is in fluid communication with separate ones of the fluid manifolds in heat exchanger 312. In the specific embodiment illustrated, fluid opening 306 communicates with the oil outlet manifold of heat exchanger 312, via a corresponding opening (not shown) formed in the first shim plate 362 and is coupled to the corresponding fluid port (i.e. the oil inlet port) on the engine housing via corresponding openings in the both the second shim plate 362' and second adapter plate 360' (see opening 376). Fluid opening 304 communicates with the coolant inlet manifold from heat exchanger 312 via a corresponding opening (not shown) formed in the first shim plate 362 and is coupled to a corresponding fluid port (i.e. the coolant inlet port) on the engine housing via corresponding openings in the second shim plate 362' and the second adapter plate 360' (see opening 308).

While a particular embodiment of the fluid circuiting through heat exchanger module 300 has been described, it will be understood by those skilled in the art that this is not intended to be limiting and that variations to the exact fluid circuits through the heat exchanger module 300 and the number and location of the fluid ports provided on the heat exchanger 312 and/or plates of the adapter module 314 will depend on the particular structure of the heat exchanger 312 and the particular application of the heat exchanger module 300.

As shown in the drawings, the second adapter plate 360' is generally thinner than the first adapter plate 360 and generally corresponds to the shape of the first adapter plate 360. The second adapter plate 360' includes at least one cylindrical projection 321 that extends from the bottom or second surface 365 of the second adapter plate 360', wherein the open end of the cylindrical projection 321 serves as outboard fluid port 372 of the adapter module 314. The cylindrical projection 321 is adapted to house a valve component 323, such as an anti-drain valve or a thermal bypass valve, to control the flow of one of the fluids (i.e. engine oil) to the heat exchanger 312. The valve component 323 may be threadingly engaged in the cylindrical projection 321 or housed within the cylindrical projection in any suitable manner as known in the art. For instance, the valve component 323 may be press-fit into the cylindrical projection 321 and secured or clamped in place between the extended shim plate 362 and the cylindrical projection 321 by means of indentations that are formed in the lower edge of the cylindrical projection 321 after assembly.

Figure 14:
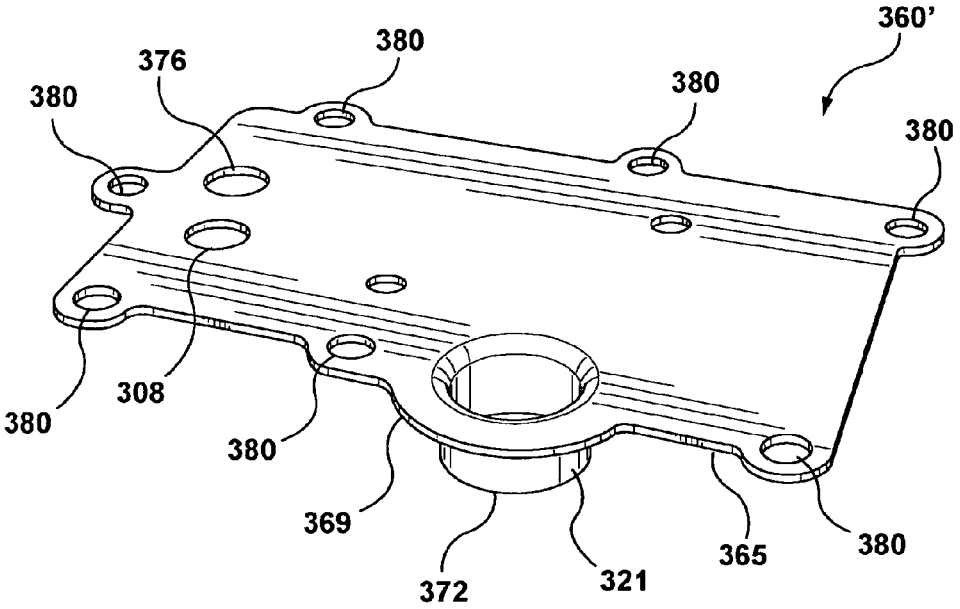
FIG. 14 is a perspective view of a portion of the adapter module of FIG. 13.
Figure 15:
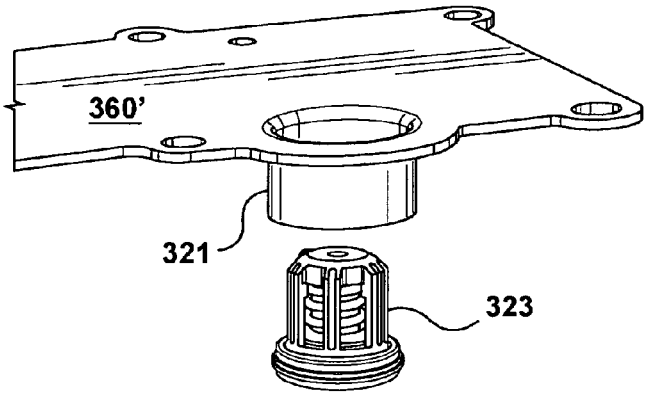
FIG. 15 is an exploded view of a portion of the adapter module of FIG. 12.
Figure 16:
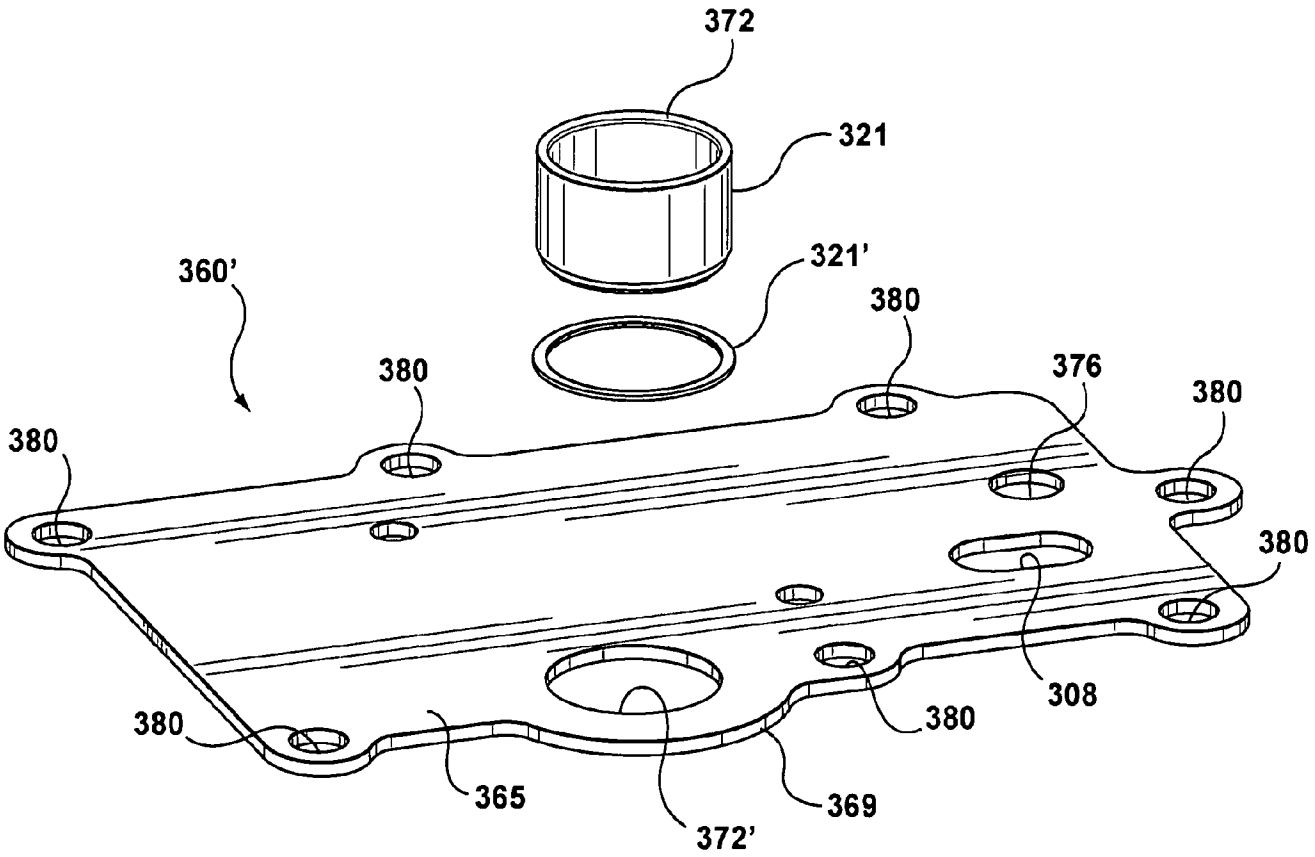
FIG. 16 is an exploded, perspective view of the underside of a portion of an alternate embodiment of the adapter module of FIG. 14.
Figure 17:
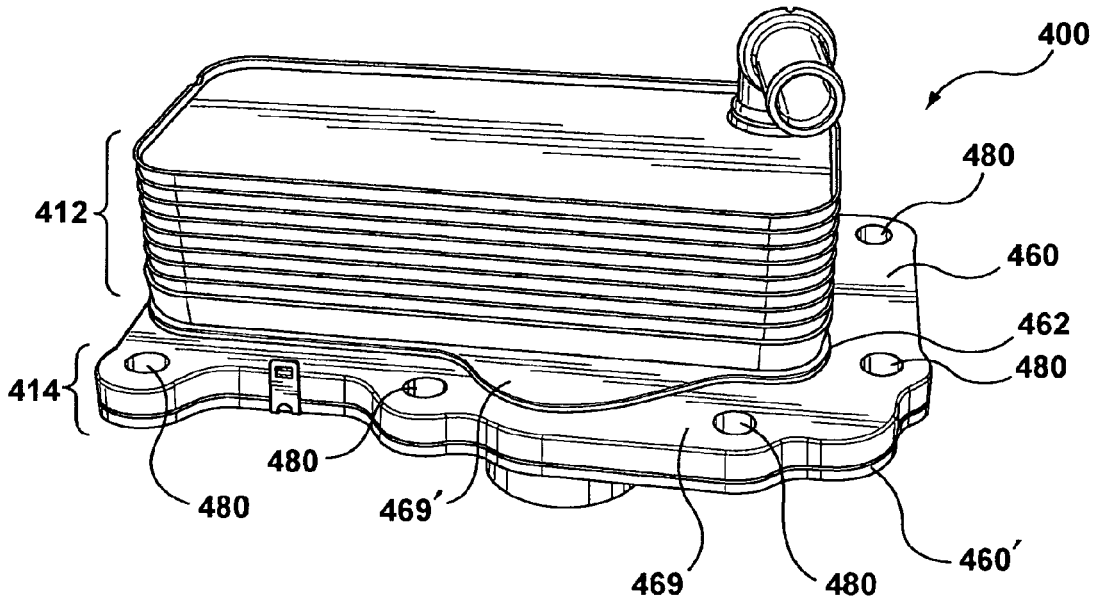
FIG. 17 is a perspective view of a heat exchanger module according to yet another exemplary embodiment of the present disclosure.
Figure 19:
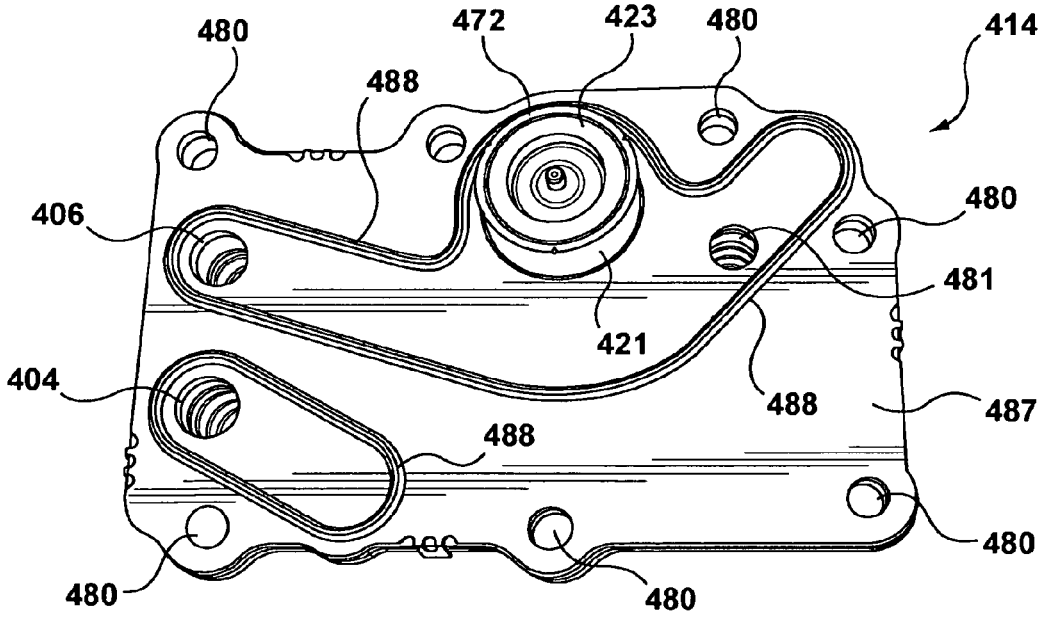
FIG. 19 is a bottom perspective view of the heat exchanger module of FIG. 17.
Figure 18:
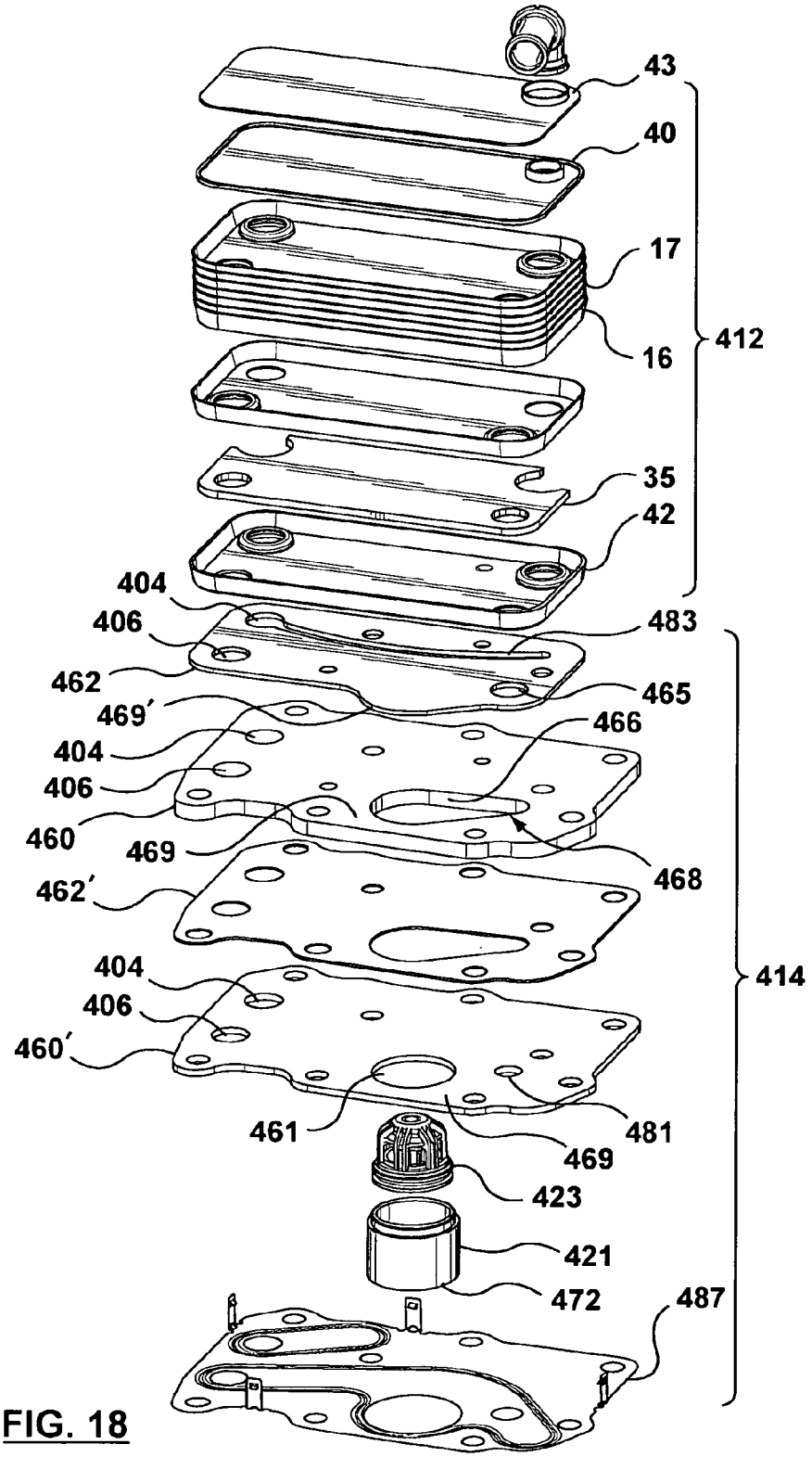
FIG. 18 is an exploded, perspective view of the heat exchanger module shown in FIG. 17.

In some embodiments, the cylindrical projection 321 is formed directly within the second adapter plate 360' (as shown in FIG. 14) and in other embodiments the cylindrical projection 321 can be formed from a separate component that is brazed (by means of a shim ring 321') or otherwise attached to the outer surface of the second adapter plate 360' in alignment with a corresponding opening 372' formed in the adapter plate 360' to form the outboard fluid port 372 as shown, for example, in FIG. 16.

The first and second adapter plates 360, 360' are also both provided with a plurality of bores 380 around the perimeter thereof, each of which align with corresponding openings in the automobile system component housing (i.e. the engine housing) and are adapted for receiving a fastening device (such as a bolt) for securing the heat exchanger module 300 to the component housing.

While the adapter module 314 described above and shown in the related drawings has only one fluid transfer channel 368 and has three fluid ports 372, 376, 308 formed on its bottom or mounting surface 365, it will be understood that the adapter module 314 can be modified to include additional fluid channels and/or a different arrangement of fluid ports depending upon the particular application. As well, the adapter module 314 can be further modified so as to house additional components such as, for example, additional valve components and/or filters.

Furthermore, it will be understood that while the embodiment described above in connection with FIGS. 12-16 has been described in the context of an engine oil cooler being mounted directly to the exterior of the engine housing, the adapter module 314 may be modified and/or adapted for use for other applications. For instance, in the embodiment shown, the first adapter plate 360 is a relatively thick plate and provides a certain degree of structural rigidity necessary for mounting heat exchangers to engine housings. However, the thickness and/or material of the plate could be varied in instances where the same degree of structural rigidity is not necessarily required. Additionally, in some instances it may be appropriate to eliminate the second shim plate 362' when the second adapter plate 360' can be formed of braze-clad material.

Referring now to FIGS. 17-21, there is shown another exemplary embodiment of a heat exchanger module 400 according to the present disclosure Heat exchanger module 400 is similar in structure to the heat exchanger module 300 described above in connection with FIGS. 12-16 in that it too has a generally layered plate structure and is particularly suited for direct mounting to the exterior of an automobile engine housing (or casing) and, therefore also functions as an engine oil cooler (EOC) in the subject embodiment. However, it will be understood that the heat exchanger module 400 can be adapted for other purposes or applications in accordance with the scope of the present disclosure.

As shown in the drawings, heat exchanger module 400 is comprised of heat exchanger 412 that is secured/attached to adapter module 414. The adapter module 414 is a layered plate structure comprising a first adapter plate or channel plate 460 and a second adapter plate or base plate 460'. The first adapter plate or channel plate 460 is brazed to an end of the heat exchanger 412 by means of a first shim plate or extended shim plate 462 (since it extends beyond the footprint of the heat exchanger 412 to enclose the trough portion 466). The second adapter plate 460' is brazed to the second or bottom surface of the first adapter plate 460 either directly or by means of a second or intermediate shim plate 462'.

The first adapter plate or channel plate 460 is a relatively thick machined, stamped or formed aluminum plate. The second adapter plate 460' is a similarly formed plate although the second adapter plate or base plate 460' may not be as thick as the first adapter plate 460. Together, the first and second adapter plates 460, 460' offer the structural rigidity required in order to directly mount the heat exchanger modules 400 to the engine housing. The first and second shim plates 462, 462' are substantially thinner than the adapter plates 460, 460', as is generally understood in the art and are typically made of braze clad aluminum for brazing the first and second adapter plates 460, 460' together in their layered relationship to form the adapter module 414.

The first adapter plate or channel plate 460 is larger than the footprint of the heat exchanger 412 so as to provide an extension arm or extension portion 469 that extends beyond the perimeter of the heat exchanger core. A trough portion 466, in the form of a cut-out, is formed in the first adapter plate or channel plate 460 and extends into the extension arm or extension portion 469 of the first adapter plate 460. When the plates are arranged in their stacked or layered arrangement, the first adapter or channel plate 460 together with the second adapter plate or base plate 460' and first shim plate 462 form a first fluid transfer channel 468 as the first shim plate 462 and the second adapter plate 460' essentially enclose the cut-out or trough portion 466 in the first adapter plate 460 to form the first fluid transfer channel 468. As in the previously described embodiments, one end of the first fluid transfer channel 468 communicates with one of the inlet/outlet manifolds of the heat exchanger 412. In the subject embodiment where the heat exchanger module 400 is adapted for use as an EOC mounted directly on the engine housing, the first fluid transfer channel 468 communicates with the oil inlet manifold to the heat exchanger 412.

The second adapter plate or base plate 460' generally has the same shape as the first adapter plate 460 and has a primary or main fluid opening 461 formed therein which communicates directly with the portion of the first fluid transfer channel 468 that extends into the extension portion 469 of the adapter module 414. In the subject embodiment, the main fluid opening 461 is fitted with a separate cylindrical projection 421 that is attached or otherwise fixed to the second adapter plate 460' with the cylindrical projection 421 extending away from the bottom thereof. The free end 472 of the cylindrical projection 421 is adapted to fit directly with or mount directly to the engine oil outlet on the engine housing. A valve component 423 in the form of an anti-drain valve fits within the cylindrical projection 421 which serves as the oil inlet to the adapter module 414 in order to control the flow fluid into/out of the adapter module 414. More specifically, when the valve component 423 is in the form of an anti-drain valve, the valve component 423 is intended to allow for one-way flow, against gravity, into the adapter module 414 through fluid opening 472. Accordingly, the anti-drain valve serves to prevent the fluid from flowing out of the adapter module 414 through the same fluid opening 472, i.e. the oil inlet into the adapter module 414, with gravity.

The first shim plate 462 is positioned on top of the first adapter plate 460 and generally has the same shape as the bottom of the heat exchanger 414 but has a portion 469' that extends beyond the footprint of the heat exchanger core in order to enclose the trough or cut-out portion 466 to form the first fluid transfer channel 468. Accordingly, the first shim plate 462 can also be referred to as an extended shim plate since it extends beyond the boundary of or the footprint of the heat exchanger. The first shim plate is also provided with a fluid opening 465 for providing direct fluid communication between the oil inlet manifold in heat exchanger 414 and the fluid transfer channel 468.

The first shim plate 462, the first adapter plate 460, the intermediate shim plate 462' (if used) and the second adapter plate 460' are all also provided with at least two additional fluid openings 404, 406 which all align with each other when the plates are arranged in their stacked or layered arrangement. The aligned fluid openings 404, 406 provide for fluid communication between respective inlet/outlet manifolds associated with heat exchanger 414. In the specific, illustrated embodiment, fluid opening 406 is in direct communication with the oil outlet manifold of heat exchanger 412 while fluid opening 404 is in direct communication with the coolant inlet manifold in the heat exchanger 414. Therefore, when the heat exchange module 400 is mounted to the engine housing, the fluid openings 461, 406, 404 on the bottom or interface surface of the adapter module 414 allows for fluid communication between the heat exchanger 412 and the engine to allow for engine oil to enter/exit the heat exchanger module 400 and be returned to the engine housing and also allows for engine coolant to exit the engine housing and enter the heat exchanger module 400 before being directed elsewhere in the system via the coolant outlet located on the top of the heat exchanger 412.

In the illustrated embodiment, the adapter module 414 further provides for both engine oil and coolant bypass channels to allow engine oil that does not enter the heat exchanger 412 to drain back into the engine housing and to allow engine coolant to bypass the heat exchanger 412 and be directed directly to the outlet manifold of the heat exchanger 412. By providing for both oil and coolant bypass flows within the adapter module 414, the heat exchanger module 400 can be tuned or adjusted to changes in fluid pressure within the system.

Figure 20:
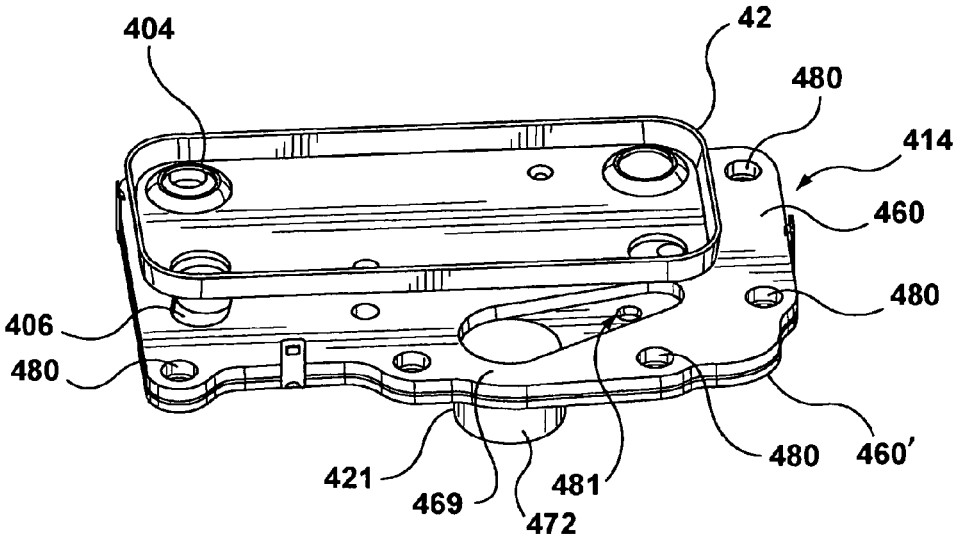
FIG. 20 is an exploded view of a portion of the heat exchanger module of FIG. 17 illustrating the oil side of the adapter module.
Figure 21:
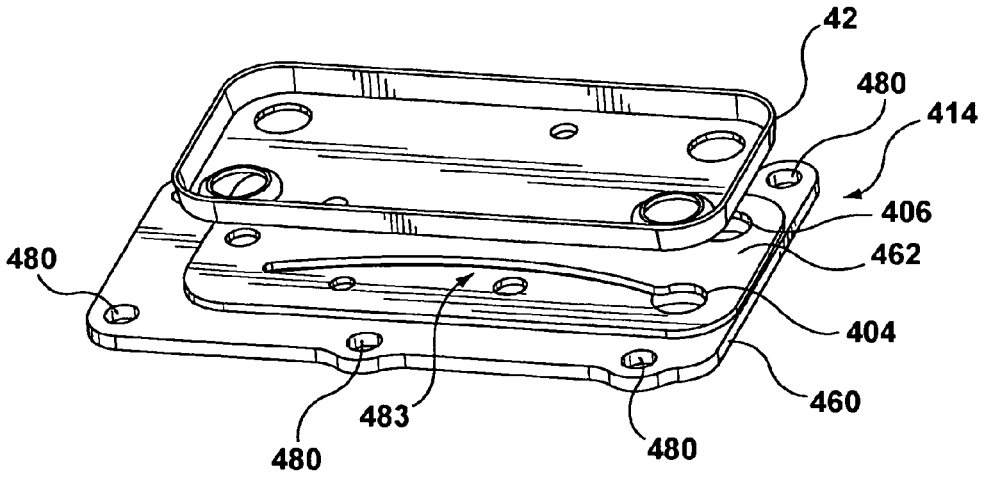
FIG. 21 is an exploded view of a portion of the heat exchanger module of FIG. 17 illustrating the coolant side of the adapter module.

In order to allow for engine oil to bypass the heat exchanger 412 and be returned to the engine housing, the adapter module 414 is provided with a first bypass opening 481 in fluid communication with the first fluid transfer channel 468 (as shown more clearly in FIG. 20). The first bypass opening 481 is therefore formed in the second adapter plate or base plate 460' spaced apart from the main fluid opening 461 and in-line with the opening to the oil inlet manifold of heat exchanger 412. The first bypass opening 481 is therefore in communication with the first fluid transfer channel 468 directly opposite to the oil inlet manifold of the heat exchanger 412. When the heat exchanger module 400 is mounted in face-to-face contact with the engine housing at the interface surface, the bypass opening 481 is arranged in vertical alignment with the oil inlet opening on the engine housing.

In order to provide for coolant bypass flow within the heat exchanger module 400, the adapter module 414 is provided with a second fluid transfer channel 483 (see FIG. 21) in order to provide fluid communication between the inlet and outlet manifolds for the second fluid flowing through the heat exchanger 412 which, in the illustrated embodiment, is engine coolant. The second fluid transfer channel 483 allows engine coolant to bypass the heat exchanger 412 and instead be directed directly to the outlet manifold of the heat exchanger 412 (without having to flow through the heat transfer fluid passageways formed therein) and out of the heat exchanger 412 through the outlet fitting located at the top of the heat exchanger 412. Accordingly, the second fluid transfer channel 483 provides a form of bypass channel permitting the coolant to exit the heat exchanger 412 and be directed elsewhere in the system without having to flow through the heat exchanger 412. The second fluid transfer channel 483 is formed by a second trough portion formed in the first or extended shim plate 462 with the second trough portion extending from the fluid opening 404 to the opposed end of the shim plate 462, the opposed end of the second trough portion therefore being aligned with the coolant outlet manifold of heat exchanger 412. When the heat exchanger 412 is attached to the adapter module 414, the lowermost plate 42 of the heat exchanger 412 essentially encloses the second trough portion 485 formed in the adapter module 414, thereby forming the second fluid transfer channel 483. Accordingly, in this embodiment, the adapter module 414 not only provides for fluid communication between the automobile system component housing (i.e. the engine housing) and the heat exchanger 412, but also provides for fluid communication between a pair of corresponding inlet/outlet manifolds for one of the heat exchange fluids flowing through the heat exchanger 412.

In order to ensure an appropriate seal at the interface between the heat exchanger module 400 and the automobile system component housing (i.e. the engine housing), the adapter module 414 further comprises a gasket plate 487 affixed to the bottom surface of the second adapter plate or base plate 460'. The gasket plate 487 is formed with sealing members 488 that essentially encircle or surround the fluid passageways and/or openings provided at the interface surface between the engine housing and the heat exchanger module 400.

Furthermore, as in the previously described embodiments, the adapter module 414 is provided with a plurality of openings 480 formed at spaced apart intervals around the perimeter of the adapter module 414 each for receiving a fastening device for securing the heat exchanger module 400 to the automobile system component housing. Accordingly, it will be understood that the openings 480 are formed by corresponding, axially aligned openings in each of the plates that make up the layered plate structure of the adapter module 414.

In use, when the heat exchanger module 400 is positioned on the outer surface of the engine housing, engine oil exits the engine housing and enters the adapter module 414 via fluid opening 461 through anti-drain valve 423. The engine oil then travels through the first fluid transfer channel 468 and either enters the heat exchanger 412 oil inlet manifold through the corresponding opening formed in the first shim plate 462 or exits the adapter module 414 through the bypass opening and is returned to the engine housing through the oil inlet opening formed in the engine housing. It will be understood that appropriate fluid communication channels are provided in the interface surface on the engine housing, based on the specific design of the engine housing, to enable the engine oil to flow back into the engine housing and that both the adapter module 414 and the interface surface can be adapted for specific applications.

For engine oil that enters heat exchanger 412 through the adapter module 14 (as opposed to the "bypass" oil that is returned to the engine housing), the oil travels through the heat exchanger 412 and exits the heat exchanger 412 through the oil outlet manifold on the bottom of the heat exchanger and is returned to the engine housing through the engine oil inlet opening provided on the housing via the adapter module 414. As for the second fluid, i.e. engine coolant, flowing through the heat exchanger 412, this fluid exits the engine housing and enters the adapter module 414 and is directed either to the coolant inlet manifold in the heat exchanger 412 via fluid opening 404, or travels through the second fluid transfer channel 483 formed in the adapter module 414 to the outlet manifold of the heat exchanger 412 effectively bypassing heat exchanger 412. Both coolant streams, i.e the coolant that flows through the heat exchanger 412 and the "bypass coolant" exits the heat exchanger 412 through the coolant outlet provided on the top of the heat exchanger 412.

By providing the bypass opening and the second fluid transfer channel within the adapter module 414, fluid pressure drops within the heat exchanger module 400 can be tuned to appropriate levels based on the particular application or system requirements to ensure that heat transfer performance associated with the heat exchanger module is not adversely affected by changes in fluid pressure.

While a particular embodiment of the fluid circuiting through heat exchanger module 400 has been described, it will be understood by those skilled in the art that this is not intended to be limiting and that variations to the exact fluid circuits through the heat exchanger module 400 and the number and location of the fluid ports provided on the adapter module 414 will depend on the particular structure of the heat exchanger 412 and the particular application of the heat exchanger module 400.

Furthermore, while the present invention has been illustrated and described by the various exemplary embodiments referred to in the present disclosure, it will be understood that the present disclosure is not intended to be limited to the exemplary embodiments and details shown herein since it will be understood that various omissions, modifications, substitutions, etc. may be made by those skilled in the particular art without departing from the spirit and scope of the present disclosure.

We claim:

1. A heat exchanger module for mounting directly to the outer surface of a housing of an automobile system component, the heat exchanger module comprising:

a heat exchanger comprising a plurality of stacked heat exchange plates defining alternating first and second fluid paths through said heat exchanger, the heat exchanger having a footprint corresponding to the area defined by the stack of heat exchange plates;

a pair of first fluid manifolds extending through the heat exchanger and coupled to one another by the first fluid paths, the pair of first fluid manifolds comprising an inlet manifold and an outlet manifold for the flow of a first fluid through said heat exchanger;

a pair of second fluid manifolds extending through the heat exchanger and coupled to one another by the second fluid paths, the pair of second fluid manifolds comprising an inlet manifold and an outlet manifold for the flow of a second fluid through said heat exchanger;

a flat adapter module having a flat first surface attached to an end of the heat exchanger and a flat second surface opposite to said first surface and adapted for direct face-to-face contact with an interface surface on the outer surface of the housing of the automobile system component, the adapter module comprising:

a first fluid transfer channel formed in the adapter module, the first fluid transfer channel being in direct fluid communication with one of the inlet and outlet manifolds of one of said pairs of fluid manifolds;

a first port formed in the second surface of said adapter module, the first port being in fluid communication with the first fluid transfer channel;

a second port formed in the second surface of said adapter module, the second port being in fluid communication with the other one of the inlet and outlet manifolds of said pair of fluid manifolds; and a third port formed in the second surface of said adapter module, the third port being in fluid communication with the first fluid transfer channel;

wherein the first fluid transfer channel provides fluid communication between inlet and outlet ports formed in the interface surface of the housing of the automobile system component and an inlet manifold of said heat exchanger;

wherein the adapter module comprises:

a first adapter plate having a first surface for attaching to said heat exchanger and a second surface, the first adapter plate having an extension portion that extends away from and beyond the heat exchanger footprint;

a trough portion formed in the first adapter plate, the trough portion being in the form of a cut-out, the cut-out extending into the extension portion, the trough portion having a first end and a second end, and extending continuously between the first and second ends thereof;

a second adapter plate fixedly attached to the second surface of the first adapter plate, the second adapter plate defining said second surface of said adapter module;

a cylindrical projection extending away from a bottom surface of the second adapter plate in communication with the first end of said trough portion, the cylindrical projection having an open end corresponding to said first port;

a valve component mounted within said cylindrical projection for controlling fluid flow into or out of said first port, the valve component being in fluid communication with said at least one fluid transfer channel;

a shim plate disposed on the first surface of the first adapter plate for brazing the adapter module to the heat exchanger;

a first fluid opening formed in said shim plate providing fluid communication between said at least one fluid transfer channel and said heat exchanger, wherein the second end of the trough portion is located at the first fluid opening;

a second fluid opening formed in said shim plate for providing fluid communication between said heat exchanger and said second port;

wherein the shim plate encloses the trough portion formed in the first adapter plate, the shim plate, first adapter plate and second adapter plate defining the at least one fluid transfer channel therebetween;

wherein the first and second ports are each formed by aligned openings formed in the first and second adapter plates; and wherein each of the first adapter plate and the second adapter plate is substantially thicker than the shim plate.

2. The heat exchanger module as claimed in claim 1, further comprising:

a second fluid transfer channel formed in the adapter module, the second fluid transfer channel providing fluid communication between the inlet and outlet ports of the other pair of inlet and outlet manifolds and a corresponding fluid port formed in the interface surface of the housing of the automobile system component; and a fourth port formed in the second surface of the adapter module, the fourth port being in fluid communication with said second fluid transfer channel.

3. The heat exchanger module as claimed in claim 1, wherein the shim plate further comprises a trough portion forming said second fluid transfer channel; and wherein the heat exchanger module further comprises an intermediate shim plate disposed between said first and second adapter plates for attaching said second adapter plate to the second surface of said first adapter plate.

* * * * *